US010814643B2

(12) United States Patent
Herre et al.

(10) Patent No.: US 10,814,643 B2
(45) Date of Patent: Oct. 27, 2020

(54) COATING DEVICE AND ASSOCIATED COATING METHOD

(71) Applicant: DUERR SYSTEMS, GMBH, Bietigheim-Bissingen (DE)

(72) Inventors: Frank Herre, Oberriexingen (DE); Hans-Georg Fritz, Ostfildern (DE); Steffen Wesselky, Adelberg (DE)

(73) Assignee: Dürr Systems AG, Bietigheim-Bissingen (DE)

( * ) Notice: Subject to any disclaimer, the term of this patent is extended or adjusted under 35 U.S.C. 154(b) by 0 days.

(21) Appl. No.: 15/911,580

(22) Filed: Mar. 5, 2018

(65) Prior Publication Data

US 2018/0250955 A1 Sep. 6, 2018

Related U.S. Application Data

(63) Continuation of application No. 13/125,854, filed as application No. PCT/EP2009/007448 on Oct. 16, 2009, now Pat. No. 10,150,304.

(30) Foreign Application Priority Data

Oct. 24, 2008 (DE) ..... 10 2008 053 178

(51) Int. Cl.
*B41J 3/407* (2006.01)
*B05B 1/14* (2006.01)
(Continued)

(52) U.S. Cl.
CPC ..... *B41J 3/4073* (2013.01); *B05B 1/14* (2013.01); *B05C 5/027* (2013.01);
(Continued)

(58) Field of Classification Search
CPC . B05C 5/027; B05C 11/1005; B05C 11/1015; B05C 11/1018; B05C 11/1036;
(Continued)

(56) References Cited

U.S. PATENT DOCUMENTS 3,708,798 A 1/1973 Hildenbrand et al.
4,508,266 A 4/1985 Saito et al.
(Continued)

FOREIGN PATENT DOCUMENTS

CN 1209363 A 3/1999
CN 1242262 A 1/2000
(Continued)

OTHER PUBLICATIONS

Article: New Sprayers Make Car Body Painting More Economical, 2004; 4 pages (inlcuding abstract).
International Search Report for PCT/EP2009/007448, dated Jan. 29, 2010.
"Types of Residential Plumbing Systems". Oct. 8, 1999. Web. Sep. 2, 2014; <<http://www.chilipperapp.com/ps.htm>>.
OBST, Manfred "Lackierereien planen and optimieren", Moderne Lackiertechnik, p. 41, 2002, ISBN: 3878707371.
(Continued)

*Primary Examiner* — Laura Edwards
(74) *Attorney, Agent, or Firm* — Bejin Bieneman PLC

(57) ABSTRACT

Exemplary coating devices and exemplary coating methods for coating components with a coating agent, e.g., for painting motor vehicle body components with a paint, are disclosed. An exemplary coating device comprises an application device that applies the coating agent. The application device may include a paint head that discharges the coating agent out of at least one coating agent nozzle.

4 Claims, 19 Drawing Sheets

(51) Int. Cl.

| | |
|---|---|
| ***B05C 11/10*** | (2006.01) |
| ***B05C 5/02*** | (2006.01) |
| ***B05B 12/12*** | (2006.01) |
| ***B05B 13/04*** | (2006.01) |
| ***B05B 14/43*** | (2018.01) |
| *B05D 5/06* | (2006.01) |
| *B05D 7/14* | (2006.01) |

(52) U.S. Cl.
CPC ..... *B05C 11/1005* (2013.01); *B05C 11/1015* (2013.01); *B05C 11/1018* (2013.01); *B05C 11/1036* (2013.01); *B05C 11/1044* (2013.01); *B05B 12/122* (2013.01); *B05B 13/0431* (2013.01); *B05B 13/0452* (2013.01); *B05B 14/43* (2018.02); *B05D 5/06* (2013.01); *B05D 7/14* (2013.01)

(58) Field of Classification Search
CPC ..... B05C 11/1044; B41J 2/04556; B41J 2/04558; B41J 3/4073; B05B 1/14; B05B 14/43; B05B 12/122; B05B 13/0452; B05B 13/0431; B05D 5/06; B05D 7/14; Y10S 901/43; Y10S 901/47
USPC ..... 118/712, 713; 901/43, 47
See application file for complete search history.

(56) References Cited

U.S. PATENT DOCUMENTS

| | | | | |
|---|---|---|---|---|
| 4,792,817 | A | 12/1988 | Barney | |
| 4,993,353 | A | 2/1991 | Ogasawara et al. | |
| 5,090,361 | A | 2/1992 | Kiyohiro et al. | |
| 5,521,477 | A | 5/1996 | Sasaki | |
| 5,602,572 | A | 2/1997 | Rylander | |
| 5,699,491 | A | 12/1997 | Barzel | |
| 5,818,477 | A | 10/1998 | Fullmer et al. | |
| 5,820,456 | A | 10/1998 | Nelson | |
| 6,062,056 | A | 5/2000 | Groch | |
| 6,096,132 | A | 8/2000 | Kaiba et al. | |
| 6,106,107 | A | 8/2000 | Sheinman | |
| 6,136,449 | A | 10/2000 | Furuuchi et al. | |
| 6,247,657 | B1 | 6/2001 | Finney, Jr. | |
| 6,264,547 | B1 | 7/2001 | Waelti | |
| 6,302,523 | B1 | 10/2001 | Smith | |
| 6,331,326 | B1 | 12/2001 | Tsunoda et al. | |
| 6,375,319 | B1 | 4/2002 | Kamano et al. | |
| 6,428,132 | B1 | 8/2002 | Kubatzki et al. | |
| 6,517,187 | B1 | 2/2003 | Dietl et al. | |
| 6,592,203 | B1 | 7/2003 | Bates et al. | |
| 6,764,162 | B2 | 7/2004 | Biddle et al. | |
| 7,182,815 | B2 | 2/2007 | Katagami et al. | |
| 7,625,065 | B2 | 12/2009 | Kanda | |
| 7,857,423 | B2 | 12/2010 | Suzuki | |
| 8,567,909 | B2 | 10/2013 | Sieber | |
| 9,085,151 | B2 | 7/2015 | Iriguchi | |
| 2002/0155069 | A1* | 10/2002 | Pruche | A01K 11/005 424/47 |
| 2002/0175962 | A1 | 11/2002 | Otsuki | |
| 2003/0029379 | A1 | 2/2003 | Onogawa et al. | |
| 2003/0048314 | A1 | 3/2003 | Renn | |
| 2003/0159651 | A1 | 8/2003 | Sakurada | |
| 2003/0186613 | A1 | 10/2003 | Kawase | |
| 2003/0202215 | A1 | 10/2003 | Biddle et al. | |
| 2004/0081770 | A1 | 4/2004 | Dattilo | |
| 2004/0165021 | A1 | 8/2004 | Desie | |
| 2005/0048897 | A1 | 3/2005 | Tong | |
| 2005/0156960 | A1 | 7/2005 | Courian et al. | |
| 2005/0179724 | A1 | 8/2005 | Salt et al. | |
| 2005/0189442 | A1 | 9/2005 | Hussaini | |
| 2006/0044376 | A1 | 3/2006 | Baird et al. | |
| 2006/0068109 | A1 | 3/2006 | Frankenberger et al. | |
| 2006/0103691 | A1 | 5/2006 | Dietl et al. | |
| 2006/0171250 | A1 | 8/2006 | Frosztega et al. | |
| 2006/0197723 | A1 | 9/2006 | Sikora et al. | |
| 2007/0034715 | A1 | 2/2007 | Clifford | |
| 2007/0035554 | A1 | 2/2007 | McClanahan | |
| 2007/0062383 | A1 | 3/2007 | Gazeau et al. | |
| 2007/0076069 | A1 | 4/2007 | Edwards et al. | |
| 2007/0097176 | A1 | 5/2007 | Hickey et al. | |
| 2007/0175175 | A1 | 8/2007 | Schwenke et al. | |
| 2008/0047486 | A1 | 2/2008 | Herre et al. | |
| 2008/0236484 | A1 | 10/2008 | Herre et al. | |
| 2008/0252671 | A1 | 10/2008 | Cannell et al. | |
| 2008/0311836 | A1 | 12/2008 | Bhattacharya | |
| 2010/0047465 | A1 | 2/2010 | Ansorge et al. | |
| 2010/0231644 | A1 | 9/2010 | Otokita | |
| 2011/0262622 | A1 | 10/2011 | Herre et al. | |
| 2015/0211461 | A1 | 7/2015 | Shirk | |

FOREIGN PATENT DOCUMENTS

| | | | |
|---|---|---|---|
| CN | 1651898 | A | 8/2005 |
| CN | 1668386 | A | 9/2005 |
| CN | 2741670 | Y | 11/2005 |
| CN | 1723126 | A | 1/2006 |
| CN | 1755405 | A | 4/2006 |
| CN | 1767904 | A | 5/2006 |
| CN | 1874848 | A | 12/2006 |
| CN | 1960809 | A | 5/2007 |
| CN | 101048289 | A | 10/2007 |
| CN | 101235252 | A | 8/2008 |
| CN | 101351341 | A | 1/2009 |
| CN | 102224012 | A | 10/2011 |
| CN | 101356245 | B | 2/2013 |
| CN | 102224012 | B | 8/2016 |
| DE | 1887910 | U | 2/1964 |
| DE | 3130096 | A1 | 5/1982 |
| DE | 3140486 | A1 | 5/1982 |
| DE | 3927880 | A1 | 1/1991 |
| DE | 1204704 | A1 | 8/1993 |
| DE | 4238378 | A1 | 5/1994 |
| DE | 29614871 | U1 | 12/1996 |
| DE | 19731829 | A1 | 1/1999 |
| DE | 19852079 | A1 | 5/2000 |
| DE | 29724351 | U1 | 12/2000 |
| DE | 102004044655 | A1 | 3/2006 |
| DE | 102006005341 | A1 | 8/2007 |
| DE | 50218929 | T2 | 12/2007 |
| DE | 102006032804 | A1 | 1/2008 |
| DE | 102006047382 | A1 | 4/2008 |
| DE | 102006060398 | A1 | 6/2008 |
| EP | 0026359 | A2 | 4/1981 |
| EP | 0206452 | A2 | 12/1986 |
| EP | 0538147 | A2 | 4/1993 |
| EP | 0970811 | A1 | 1/2000 |
| EP | 1065055 | A1 | 1/2001 |
| EP | 1095707 | A2 | 5/2001 |
| EP | 1277579 | A2 | 1/2003 |
| EP | 1449667 | A1 | 8/2004 |
| EP | 1884365 | A1 | 2/2008 |
| EP | 2208541 | A2 | 7/2010 |
| FR | 2514267 | A1 | 4/1983 |
| FR | 2862563 | A1 | 5/2005 |
| GB | 2107614 | A | 5/1983 |
| GB | 2177946 | A | 2/1987 |
| JP | S50-139138 | A | 11/1975 |
| JP | S53-126930 | A | 11/1978 |
| JP | S5625465 | A | 3/1981 |
| JP | S6028844 | A | 2/1985 |
| JP | H03151073 | A | 6/1991 |
| JP | 04063163 | A | 2/1992 |
| JP | H06121944 | A | 5/1994 |
| JP | H06134393 | A | 5/1994 |
| JP | H0679506 | U | 11/1994 |
| JP | 0994527 | A | 4/1997 |
| JP | H09164706 | A | 6/1997 |
| JP | H10197967 | A | 7/1998 |
| JP | 11076889 | A | 3/1999 |
| JP | 2000135459 | A | 5/2000 |
| JP | 2000238254 | A | 9/2000 |
| JP | 2003103791 | A | 4/2003 |
| JP | 2003144991 | A | 5/2003 |

(56) References Cited

FOREIGN PATENT DOCUMENTS

| | | | |
|---|---|---|---|
| JP | 2003-329828 | A | 11/2003 |
| JP | 2004066081 | A | 3/2004 |
| JP | 2005-088548 | A | 4/2005 |
| JP | 2006-289239 | A | 10/2006 |
| JP | 2007154431 | A | 6/2007 |
| JP | 2008-126599 | A | 6/2008 |
| JP | 2008-173942 | A | 7/2008 |
| JP | 2008-174866 | A | 7/2008 |
| JP | 2008-246713 | A | 10/2008 |
| JP | 5976320 | B2 | 8/2016 |
| JP | 2016175077 | A | 10/2016 |
| JP | 6130950 | B2 | 5/2017 |
| WO | 88/08755 | A1 | 11/1988 |
| WO | 9407698 | A1 | 4/1994 |
| WO | 9632282 | A1 | 10/1996 |
| WO | 98/28088 | A2 | 7/1998 |
| WO | 01/15812 | A1 | 3/2001 |
| WO | 2007002660 | A1 | 1/2007 |
| WO | 2007131636 | A1 | 11/2007 |
| WO | 2008125967 | A2 | 10/2008 |
| WO | 2008128019 | A1 | 10/2008 |
| WO | 2010046064 | A1 | 4/2010 |
| WO | 2010146473 | A1 | 12/2010 |

OTHER PUBLICATIONS

EPO Office Action dated Feb. 7, 2018 for Application No. EP16 001 687.9 (4 pages).

SIPO Office Action dated Feb. 1, 2018 for Application No. CN20161044566.2 (7 pages; with English translation).

SIPO Office Action dated Dec. 14, 2017 for Application No. 201610445627.7 (6 pages; with English translation).

Boeres, Yvan; Generationswechsel—iP1500/2000/3000/4000 bilden neue Canon PIXMA-Druckerfamilie (www.digitalkamera.de); https://www.digitalkamera.de/Meldung/iP1500_2000_3000_4000_bilden_neue_canon_PIXMA_druckerfamilie; Aug. 2, 2004; accessed Apr. 26, 2018 (with English machine translation).

Non-Final Office Action for USPA No. 16069926 dated Mar. 27, 2020 (45 pages).

Non-Final Office Action for USPA No. 15911580 dated May 1, 2020 (50 pages).

"Control Method for Robot Arms"; Journal of the Society of Instrument and Control Engineers, vol. 25, No. 1 (with English summary).

Non-Final Office Action for U.S. Appl. No. 16/069,907 dated Aug. 28, 2020 (57 pages).

Final Office Action for U.S. Appl. No. 16/069,926 dated Sep. 2, 2020 (24 pages).

* cited by examiner

COATING DEVICE AND ASSOCIATED COATING METHOD

CROSS-REFERENCES TO RELATED APPLICATIONS

This application is a continuation of U.S. patent application Ser. No. 13/125,854 filed Jul. 18, 2011, now U.S. Pat. No. 10,150,304, which is a National Stage application which claims the benefit of International Application No. PCT/EP2009/007448 filed Oct. 16, 2009, which claims priority based on German Application No. 10 2008 053 178.2, filed Oct. 24, 2008, all of which are hereby incorporated by reference in their entireties.

BACKGROUND

The present disclosure relates to a coating device for coating components with a coating agent, more particularly for painting motor vehicle body parts with a paint. Further, the present disclosure relates to a corresponding coating method.

FIG. 1 shows a cross-section view through a conventional painting installation for painting motor vehicle body parts. Here, the motor vehicle body parts to be painted are transported on a conveyor 1 at right angles to the drawing plane through a painting cabin 2, in which the motor vehicle body parts are then painted in the conventional manner by painting robots 3, 4. The painting robots 3, 4 have several swivelling robot arms each of which carry, via a multi-axis robot hand axis, an application device, such as, for example a rotary atomiser, an air atomiser or a so-called airless device.

The drawback of these known application devices is, however, the non-optimal degree of application efficiency, so that part of the sprayed paint, known as overspray, does not land on the motor vehicle body part to be painted and has to be removed from the painting cabin 2 with the cabin air. Above the painting cabin 2 there is therefore a so-called plenum 5 from which air is introduced through a ceiling 6 of the painting cabin 2 downwards in the direction of the arrow into the painting cabin 2. The air from the cabin 2 with the contained overspray then enters a wash-out 7 located under the painting cabin 2 in which the overspray is removed from the cabin air and bonded to water.

This waste water containing the overspray must then be treated again in a laborious process whereby the produced paint sludge constitutes specialist waste which must be disposed of in a correspondingly costly manner.

Furthermore, the air downdraft speed in the painting cabin 2 must be in the range of approx. 0.3-0.5 m/s at least in order to rapidly remove the overspray occurring during painting from the painting cabin 2.

In addition, the overspray occurring during painting can at times and locally produce an explosive atmosphere so that the relevant statutory atmosphere explosible (ATEX) product guidelines must be observed.

On the one hand, due to their unsatisfactory application efficiency and the resulting overspray the known application devices incur high investment costs for the necessary washing out and required explosion protection.

Additionally, due to the overspray occurring during operation, the known application devices are associated with high operating costs through the paint losses and the costs of disposing of the overspray.

The aim of the present disclosure is therefore to bring about an appropriate improvement.

BRIEF DESCRIPTION OF THE FIGURES

While the claims are not limited to the specific illustrations described herein, an appreciation of various aspects is best gained through a discussion of various examples thereof. Referring now to the drawings, illustrative examples are shown in detail. Although the drawings represent the exemplary illustrations, the drawings are not necessarily to scale and certain features may be exaggerated to better illustrate and explain an innovative aspect of an illustration. Further, the exemplary illustrations described herein are not intended to be exhaustive or otherwise limiting or restricting to the precise form and configuration shown in the drawings and disclosed in the following detailed description. Exemplary illustrations are described in detail by referring to the drawings as follows:

DETAILED DESCRIPTION

Figure 1:
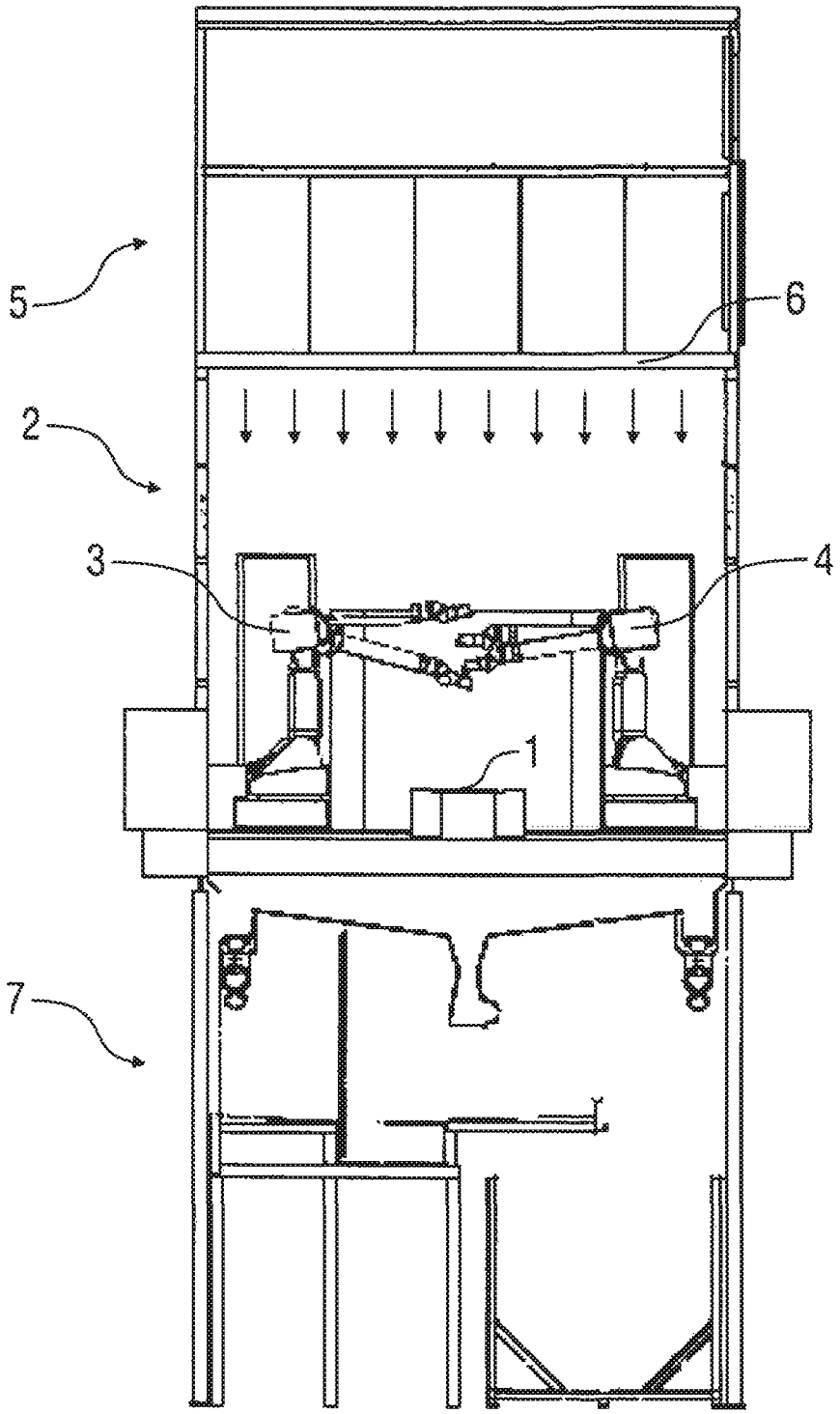
Fig. 1 Prior art
FIG. 1 shows a cross-section view of a conventional painting installation for painting motor vehicle body parts.

The exemplary illustrations comprise the general technical teaching of using an application device with such a degree of application efficiency that a wash-out in which the overspray is conventionally removed from the cabin air can be dispensed with. In one exemplary illustration, an advantage of the exemplary coating device is the fact that a separate wash-out can be dispensed with. However, the exemplary illustrations are not limited to painting installations which do not have a wash-out. Rather, through the use of application devices with a higher degree of application efficiency, it is possible to reduce the dimensions of the wash-out, in the event that it cannot be fully dispensed with.

The application device may be, according to one exemplary illustration, a print head, for example as used in a similar form in inkjet printers. It could, for example, be a bubble jet print head or a piezo print head. However, with regard to the technical principle of the print head used, the exemplary illustrations are not restricted to bubble jet print heads and piezo print heads, but can in general be implemented with other discharging mechanisms.

Also, within the context of the exemplary illustration it is possible for the print head to discharge the coating agent pneumatically. For example, the individual coating agent drops can be discharged by means of brief air pulses which accelerate the coating agent drops in the direction of the component to be coated, whereby the painting distances can be increased.

It should also be mentioned that the print head can optionally discharge the coating agent as individual coating agent droplets or continuously. Furthermore, within the context of the exemplary illustrations it is possible for some of the coating agent nozzles of the print head to discharge the coating agent continuously while some of the coating agent nozzles of the print head discharge coating agent in the form of individual coating agent droplets.

In one exemplary illustration, the print head is positioned by a multi-axis robot, whereby the robot may have several swivelling robot arms and a multi-axis robot hand axis on which the print head is mounted.

Alternatively, it is possible for the print head to be attached to a machine which moveably positions the print head relative to the component to be coated. For example, such a machine can be a conventional roof machine or a side machine, which are in themselves known from the prior art and do not therefore need to be described in more detail In contrast to the conventional print heads, as used in inkjet printers for example, the print head in the exemplary coating device, may advantageously exhibit a considerably greater surface coating output, which may be, for example, greater than 1 $m^2$/min, 2 $m^2$/min, 3 $m^2$ per minute or 4 $m^2$/min.

In contrast to conventional inkjet printers, the print head in the coating device according to the exemplary illustrations must be able to apply fluid paints containing solid paint components, such as, for example, pigments and so-called metallic flakes (micas). The individual coating agent nozzles of the print head therefore may be adapted in terms of their size to the solid paint components, so that the print head can also apply paints with the solid paint components.

However, within the context of the exemplary illustrations, instead of a print head, an atomiser can be used which discharges the coating agent from at least one coating agent nozzle.

In the case of the exemplary coating devices, too, the application device may be arranged in a painting cabin in which the components are coated with the coating agent. Such painting cabins are known from the prior art and do not therefore need to be described in more detail.

However, it has already been mentioned above that the print heads used as application devices within the context of the exemplary illustrations may generally exhibit a much greater application efficiency than conventional application devices, such as rotary atomisers. The wash-out located under the painting cabin can therefore be considerably smaller in dimension than in conventional painting installations with rotary atomisers as application devices. In one exemplary illustration, the high application efficiency of the print heads used as application devices even allows washing out or any other laborious filtering measures, e.g. dry separation or the like below the painting cabin, to be completely dispensed with. In this case simple filters suffice which can be replaced or cleaned cyclically (e.g. weekly, monthly, every six months or annually).

Further, the high application efficiency of the print heads used as application devices within the context of the exemplary illustrations allows explosion protection measures in accordance with the relevant statutory ATEX guidelines to be dispensed with, as less overspray is produced and therefore no atmosphere at risk of explosion occurs during operation. In one exemplary illustration, no explosion protection is therefore provided in the painting cabin.

However, even in the exemplary coating devices, an air extraction system may be provided which extracts the air from the painting cabin, for example with the extraction taking place downwards. The cabin air may be extracted through a filter which filters the overspray from the cabin air, whereby the air filter can be designed for example as a filter ceiling arranged on the base of the painting cabin, so that the cabin air is extracted downwards through the filter ceiling from the painting cabin.

Due to the greater application efficiency of the print heads used within the framework of the exemplary illustrations as application devices, and the reduced amount of overspray, the downdraft speed in the painting cabin can be lower than in conventional painting installations which use rotary atomisers as application devices for example. In the exemplary painting installations, the downdraft speed in the painting cabin can therefore be less than, merely as examples, 0.5 m/s, 0.4 m/s, 0.3 m/s, 0.2 m/s or 0.1 m/s.

In another exemplary illustration, at least one colour changer is assigned to the print head which is connected to the print head on the output side and is provided with various coating agents on the input side so that the colour changer selects one of the coating agents and supplies the print head with the selected coating agent. Various coating agents in the primary colours of a colour system (e.g. the CMYK colour system) may be supplied to the colour changer so that from the variously coloured coating agents a desired colour shade can be mixed together.

In addition, on the input side the colour changer can be supplied with various effect paints, such as, for example, special paints, metallic paints or mica paints.

It can be of advantage here if the colour changer only supplies one single coating agent nozzle of the print head with the selected coating agent. In another exemplary illustration, a separate colour changer is therefore assigned to each coating agent nozzle of the print head, so that the coating agent to be applied can be individually selected for the individual coating agent nozzles.

The individual colour changers can be controlled individually and independently of each other in order to select the required coating agent for the relevant coating agent nozzles.

In another exemplary illustration, on the output side the colour changer supplies a group of several coating agent nozzles with the same coating agent, whereby the coating agent nozzles can be arranged in a row for example, for instance in a line or column.

It is also possible for a colour mixer to be arranged upstream of the colour changer on the input side which on the input side is supplied with variously coloured coating agents in the primary colours of a colour system (e.g. CMYK colour system). The colour mixer mixes a desired colour shade from the various primary colours and supplies this to the colour changer for selection. Furthermore, in this exemplary illustration the colour changer may be supplied with at least one effect paint, for example a mica paint, a metallic paint and/or a special paint. The colour changer can then either select the colour shade mixed by the colour mixer or fall back on one of the effect paints.

In another exemplary illustration, a group of adjacent coating agent nozzles is each supplied with a primary colour of a colour system. For example, four adjacent coating agent nozzles are supplied with the primary colours cyan, magenta, yellow or black. In this exemplary illustration, a further adjacent coating agent nozzle may then be supplied with one of several effect paints by a colour changer. The coating agent nozzles for the primary colours and for the effect paint are spatially arranged so closely adjacent to each other in the print head that the discharged coating agents mix on the component to be coated to form the desired colour shade with a desired effect paint. In this exemplary illustration, colour mixing may therefore take place on the component to be coated.

It has already been stated above that the coating agent nozzles in the print head can be arranged in rows, for example in lines and columns. For example, the coating agent nozzles may be arranged in matrix form in the print head.

In this way it is possible within the framework of the exemplary illustrations for one primary colour (e.g. cyan, magenta, yellow, black) to be assigned to each of the individual coating agent rows so that the coating agent nozzles of one row apply the same colour. It is also possible for the coating agent nozzles within a row of nozzles to be alternately supplied with the respective primary colour (e.g. cyan, magenta, yellow, black) and with an effect paint.

If is further possible for the individual nozzle rows to each be supplied by one colour changer with the coating agent to be applied, whereby the colour changers in each row of nozzles are supplied with a particular primary colour and an effect paint. For example, the colour changer of one row of nozzles can be supplied with a coating agent of the colour cyan and a special paint, while the colour changer of the next row of nozzles is supplied with a coating agent of the colour magenta and the special paint. In the case of a CMYK colour system the colour changers in the next rows of nozzles are then supplied accordingly with the colours yellow and black respectively and with the special paint.

In addition, it is possible for the colour changers of the individual rows of nozzles to be jointly connected on the input side with a further colour changer which selects one of several effect paints. The colour changers in the individual nozzle rows can then either select the directly supplied primary colour or indirectly utilise the supplied special paints via the further colour changer.

In another exemplary illustration, a group of coating agent nozzles is jointly supplied with a particular colour shade mixed together by the colour mixer from the primary colours of a colour system. On the other hand, in this exemplary illustration, an adjacent additional coating agent nozzle is supplied by another colour changer which selects from several effect paints. Here too mixing of the selected effect paint with the previously mixed colour shade takes place on the component to be coated.

In a further exemplary illustration, one portion of the coating agent nozzles of the print head are connected to a colour mixer, which on the input side is supplied with the primary colours of a colour system. On the other hand another portion of the coating agent nozzles of the print head is connected to a special paint supply. Here too the coating agent nozzles in the print head may be arranged in a matrix form in lines and columns. It is possible for the coating agent nozzles in the individual nozzle rows (lines or columns) to be alternately connected to the colour mixer and special paint supply.

Moreover, within the framework of the exemplary illustration, it is possible for all the coating agent nozzles of the print head, or at least a majority of them, to be connected to a single coating agent supply line and therefore apply the same coating agent.

Alternatively, within the framework of the exemplary illustrations, it is possible for one portion of the coating agent nozzles of the print head to be connected to a first coating agent supply line, whereas a second portion of the coating agent nozzles of the print head is connected to a second coating agent supply line so that the print head can supply two different coating agents. In this connection, the coating agent nozzles in the individual nozzle rows (lines or columns) may alternately be connected with the one coating agent supply line or with the other coating agent supply line.

In one exemplary illustration, the print head has at least one separate coating agent nozzle which only applies special paint containing effect particles. In addition, the print head also has at least one further coating agent nozzle which applies normal paint containing no effect particles. The various coating agent nozzles can then be adapted accordingly.

It is also conceivable that in the above-described colour mixing methods the effect particles (e.g. metallic, mica etc.) are applied to the object with a separate coating agent nozzle. In this way the effects can be applied to the object very specifically and with local differences. In certain circumstances effects can be achieved which are not conceivable at all today. With the new inkjet technology it is possible to place the effect particles only on the upper surface of the layer for example.

It is also a major principal advantage of the exemplary illustrations that it is possible for the first time to coat a complete motor vehicle body with sufficient surface output but also to print specific details and graphics.

It has already been mentioned above that the coating agent nozzles in the print head may be arranged in a matrix form in several lines and columns. In another exemplary illustration, the individual coating agent nozzles of the print head are essentially of equal size. The adjacent nozzle rows can be offset with regard to each other in the longitudinal direction, more particularly by half the width of a nozzle, which allows a maximum packing density of the coating agent nozzles in the nozzle head. In addition, the individual nozzle rows may be arranged transversely, more particularly perpendicularly to the direction of advance of the nozzle head.

In another exemplary illustration, the print head has nozzle openings of different sizes. Thus, in the print head rows of nozzles with large coating agent nozzles and rows of nozzles with small coating agent nozzles can be arranged alternately. Here too it may be useful for the rows of nozzles comprising the larger coating agent nozzles to be offset with regard to each other, more particularly by half the width of a nozzle.

In another exemplary illustration, the print head is rotatably mounted and rotates during coating. Here too the print head can have coating agent nozzles of various sizes, whereby the smaller coating agent nozzles may be arranged closer to the rotational axis of the print head than the larger coating agent nozzles.

In another example, several print heads are provided which are jointly guided by one device (e.g. a multiple axis robot) and can be swivelled with regard to each other, which allows adaptation to curved component surfaces.

It has already been stated above that within the framework of the exemplary illustrations, various primary colours of a colour system can be mixed in order to obtain a desired colour shade, whereby the colour mixing can take place either in a colour mixer or on the component surface to be coated. The colour system can optionally be the CMYK colour system or the RGB colour system, to name but a few examples. However, with regard to the colour system used, the exemplary illustrations are not limited to the specifically aforementioned examples.

It has also been stated above that a special paint, a metallic paint or a mica paint, for example can be used as effect paints.

Furthermore, it can be advantageous to provide the surface areas of the print head (e.g. leads) that come into contact with the coating agent at least partially with a wear-reducing coating, such as, for example, a Diamond-Like Carbon (DLC) coating, a diamond coating, a hard metal or a material combination of a hard and a soft material. In addition, the surface areas of the print head coming into contact with the coating agent can be coated with titanium nitride, titanium oxide or chemical nickel, or with another layer produced by way of a Physical Vapour Deposition (PVC) process, Chemical Vapour Deposition (CVD) process, or an Electrolytic Oxidation of Aluminium (Eloxal) process, or be provided with an "easy-to-clean" coating.

Furthermore, to improve the coating efficiency of the print head, electrostatic coating agent charging and/or compressed air support can be provided.

A further possibility consists in position detection which detects the spatial position of the print head and/or the component surface to be coated and controls/regulates the positioning of the print head accordingly.

Currently it is also being endeavoured to mix motor vehicle paint from 6-10 primary pastes directly in the painting installations. For this the pastes are mixed in the conventional manner in mixing stations and the colour shades adjusted. From these pastes all paints used in the automobile industry (uni, metallic and mica and/or effect paints) can be produced. It is conceivable for these paints to be mixed directly in the atomiser or in an upstream device. This has the advantage that only the required amount is fully automatically supplied directly before or during application. The dosing of the individual components can take place with the known dosing techniques (pressure regulator, dosage pumps, gear wheel measuring cells, throughflow measuring cells, piston type dosing system . . . ). The "mixing room" can be a mixing chamber, a hose section or a mixing system (e.g. Keenix mixer). The problem is the very precise dosing of the individual components in order to achieve the correct colour shade. A colour sensor for regulating the dosing unit can therefore be useful.

However, the inkjet technology can also be used as dosing technique. Here, the required quantity of individual droplets, which are dependent on the opening time of the nozzle and the pressure, can be produced. These inkjet nozzles again mix the colour shade in a mixing room.

Moreover, within the framework of the exemplary illustrations it is possible to provide a sensor which detects the course of a guide path in order to position the print head in relation to the guide path.

In one exemplary illustration, the sensor is attached to the print head or to the robot, but in principle other designs are also possible. For example, the sensor can detect the previous paint path so that the current paint path can be applied at a position relative to the previous paint path. Thus, in general it may be desirable for the current paint path to be applied a certain distance parallel to the previous paint path, which is possible through the above-described sensor detection.

In another exemplary illustration, the sensor is an optical sensor, but in principle other types of sensors are also possible.

The aforementioned guide path can also be a separate guide path which is only applied for guiding purposes and can, for example, comprise a normally invisible colour that is only visible to the sensor when illuminated with ultraviolet (UV) or infra-red (IR) light.

In connection with this it is also possible to use a laser measuring system. Such a laser measuring system, for example, can also detect the distance to the surface of the component to be coated and keep it constant as part of a regulation system.

In this exemplary illustration, a robot controller is provided which on the input side is connected to the sensor and on the output side to the robot, whereby the robot controller positions the print head as a function of the course of the guide path.

In one example, the print head has a sheath flow nozzle with emits a sheath flow of air or another gas, whereby the sheath flow encompasses the coating agent flow emitted by the coating agent nozzle in order to atomise and/or delimit the coating agent droplets. In addition, this sheath flow in the form of an air curtain can direct the resulting overspray onto the component surface, thereby improving the application efficiency.

In another exemplary illustration, the print head has several coating agent nozzles which are arranged next to each other in relation to the direction of the path, whereby the outer coating agent nozzles emit less coating agent than the inner coating agent nozzles, which leads to an corresponding layer thickness of the distribution transversely to the path direction. Nozzles do not necessarily have to be arranged in a row. The paint quantity can be controlled for each nozzle and each pixel. Through different quantities of paint the colour shade intensity, for example, is controlled. Here it is possible for the layer thickness distribution to be a Gaussian normal distribution. Alternatively, it is possible for the coating agent quantity emitted by the individual coating agent nozzles to be selected so that the layer thickness distribution is a trapezoidal distribution. Such a trapezoidal layer thickness distribution is advantageous as the adjacent coating agent paths can overlap each other in such a way that the superimposition of the trapezoidal layer thickness distributions of the adjacent coating agent paths results in a constant layer thickness.

In another exemplary illustration, the components to be coated are carried along a conveyor path, as known in painting installations from the prior art and therefore does not need to be described in more detail. In this exemplary illustration a portal spans the conveyor path, whereby numerous print heads are mounted on the portal which are directed at the components on the conveyor path and coat the components.

It should also be mentioned that the coating agent may be applied to the component in the form of pixels, whereby the individual pixels each consist of several primary colours of a colour system in order, through colour mixing, to achieve a desired colour of the pixel. The colour mixing can, for example be subtractive colour mixing, but in principle it is also possible to achieve the desired colour through additive colour mixing. In this connection, the various primary colours (e.g. red, green, blue) of the relevant colour system (e.g. RGB colour system) are arranged on top of one another in layers in the individual pixels. With such pixelated application of the coating agent it is possible for the upper layer of a pixel to have an effect paint and be semi-transparent so that the uppermost layer achieves the desired effect and at the same time lets through the desired colour produced by the underlying layers.

Finally the exemplary illustrations also comprise corresponding coating methods, as is already evident from the above description.

The technology according to the various exemplary illustrations can also be used for the specific coating of cut edges of previously coated metal sheets, punched boards or for the efficient sealing of seams and edges.

Other advantageous exemplary illustrations are explained below in more detail together with the description of the exemplary illustrations with the aid of the figures.

Figure 2:
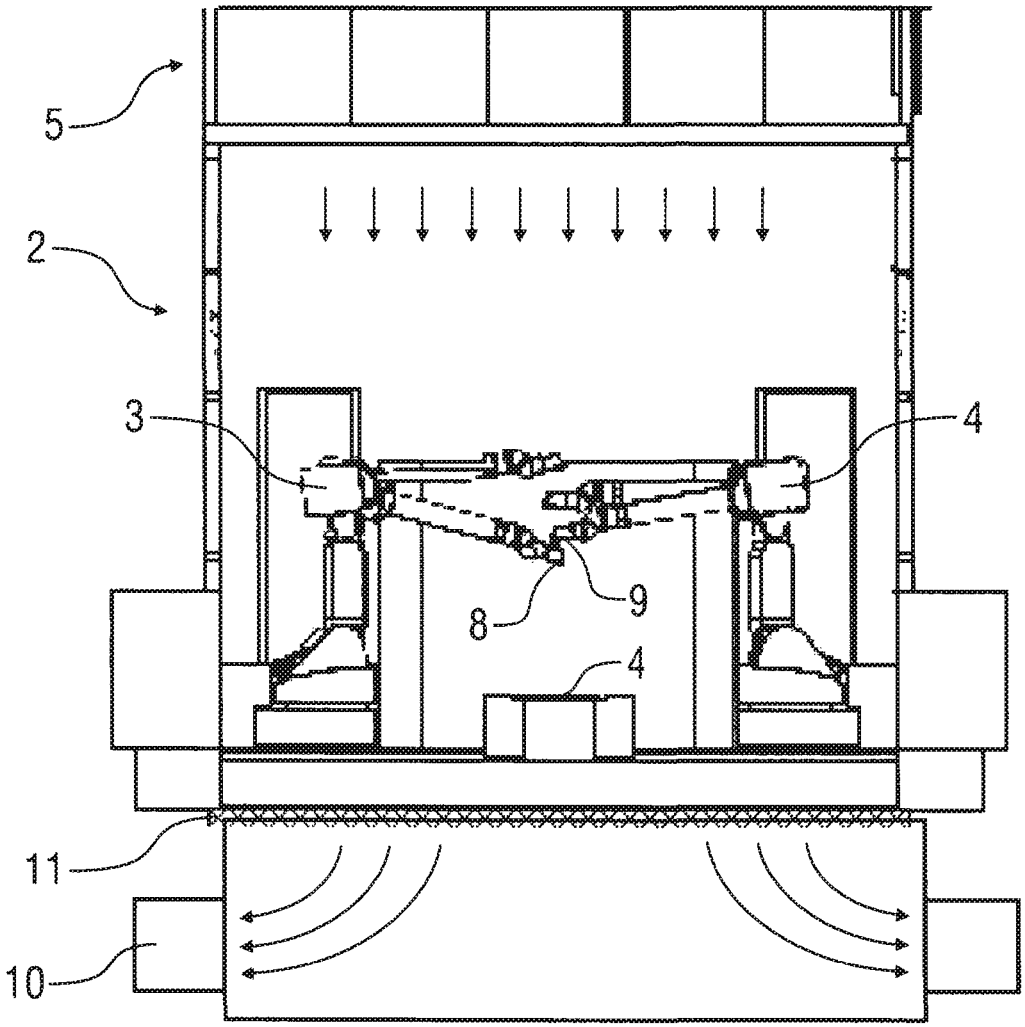
FIG. 2 shows a cross-section view of an exemplary painting installation for painting motor vehicle body parts with print heads as application devices.

The cross-section view in FIG. 2 shows an exemplary painting installation.

Motor vehicle body parts to be painted may be transported on a conveyor 1 at right angles to the drawing plane through a painting cabin 2, in which the motor vehicle body parts are then painted in the conventional manner by painting robots 3, 4. Above the painting cabin 2 there may be a plenum 5 from which air is introduced through a ceiling 6 of the painting cabin 2 downwards in the direction of the arrow into the painting cabin 2. A special feature of the exemplary painting installation initially consists in the fact that the painting robots 3, 4 do not have rotary atomisers as application devices, but print heads 8, 9, which have a much greater application efficiency of more than 95% and therefore produce much less overspray.

On the one hand this has the advantage that the wash-out, e.g., wash-out 7 present in the conventional painting installation in accordance with FIG. 1, can be dispensed with.

Instead, the exemplary painting installation shown in FIG. 2 has an air extractor 10 under the painting cabin 2 which extracts the cabin air downwards from the painting cabin 2 through a filter ceiling 11. The filter ceiling 11 filters the small amount of overspray out of the cabin air without any wash-out being required, e.g., wash-out 7 as in the conventional painting installation.

In this exemplary illustration, the print heads 8, 9 operate on the piezo principle like conventional print heads, but the surface coating performance of the print heads 8, 9 is much greater than conventional print heads so that the motor vehicle body parts can be painted at a satisfactory working speed.

Figure 3A:
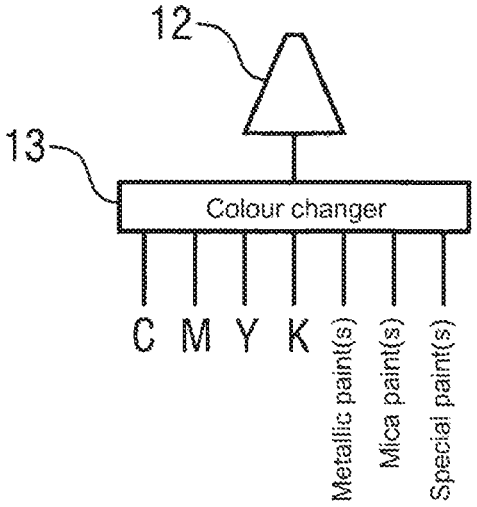
FIG. 3A shows a nozzle of an exemplary print head with a colour changer and the associated coating agent supply.

FIG. 3A shows a coating agent nozzle 12, which in each of the print heads 8, 9 may be arranged in addition to numerous other coating agent nozzles, whereby the coating agent nozzle 12 is supplied with the coating agent to be applied by a colour changer 13. On the input side the colour changer 13 is connected to a total of seven coating agent supply lines from which the colour changer 13 can select one for supplying coating agent to coating agent nozzle 12. Four coating agent supply lines of the colour changer 13 are for supplying variously coloured coating agents in the primary colours C (Cyan), M (Magenta), Y (Yellow) and K (Key=black). The other three coating agent supply lines of the colour changer 13 are for supplying a metallic paint, a mica paint and a special paint.

In this exemplary illustration, the desired colour shade of the coating agent is mixed on the motor vehicle body component to be coated, whereby time-based or local mixing is optionally possible.

In time-based mixing, coating agent droplets in the primary colours C, M, Y and K are, for example, consecutively applied in the required colour ratio so that the coating agent droplets then mix on the motor vehicle body component to be coated.

On the other hand, in local mixing coating agent droplets of a particular primary colour C, M, Y or K are applied from the coating agent nozzle 12, which then mix on the motor vehicle body parts with other coating agent droplets applied by another coating agent nozzle, which is not shown in FIG. 3A.

Figure 3B:
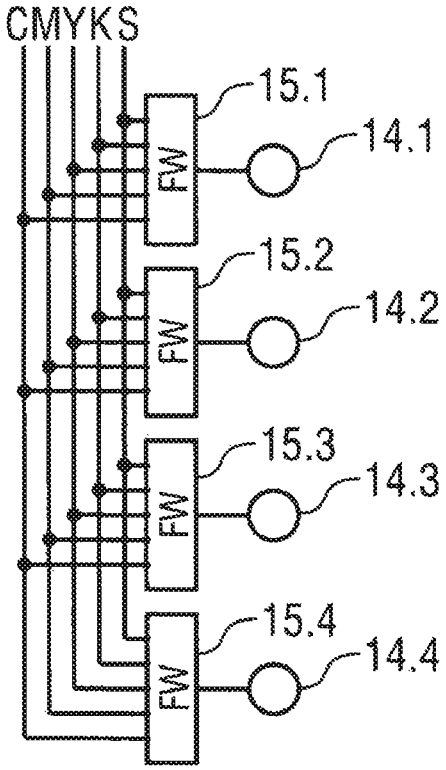
FIG. 3B shows a nozzle row of an exemplary print head with several coating agent nozzles each with individually allocated colour changers.

FIG. 3B shows a modification of the exemplary illustration of FIG. 3A in which a nozzle row with four coating agent nozzles 14.1-14.4 and four colour mixers 15.1-15.4 is shown.

The colour changers 15.1-15.4 are jointly connected to five coating agent supply lines via which the colour changers 15.1-15.4 are supplied with the four primary colours C, M, Y, K of the CMYK colour system and also with a special paint S.

Figure 4A:
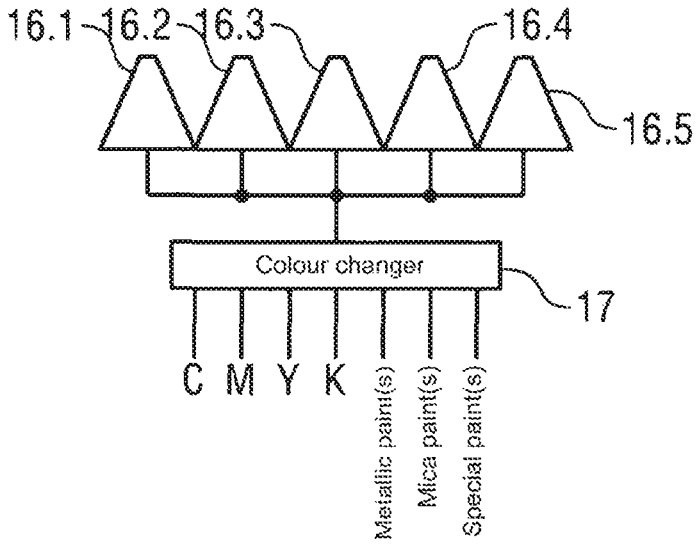
FIG. 4A shows a nozzle row with several coating agent nozzles and an allocated colour changer.

FIG. 4A shows a group of coating agent nozzles 16.1-16.5, which are jointly connected to the outlet of a colour changer 17 and therefore apply the same coating agent in operation.

On the input side the colour changer 17 is connected to seven coating agent supply lines of which four coating agent supply lines supply the primary colours C, M, Y, K of the CMYK colour system, while the other three coating agent pipelines supply a metallic paint, a mica paint and a special paint respectively.

Figure 4B:
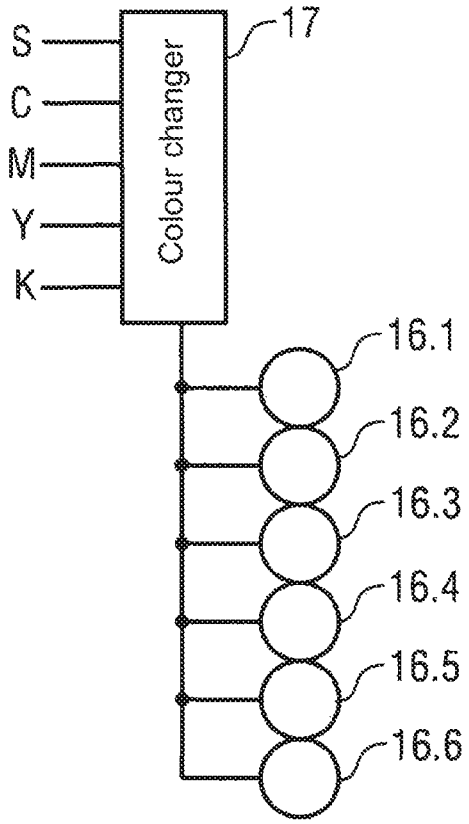
FIG. 4B shows a modification of FIG. 4A, where on the input side the colour changer only has one single special colour supply.

The exemplary illustration of FIG. 4B largely corresponds with the exemplary illustration previously described and shown in FIG. 4A, so that in order to avoid repetition, reference is made to the above description with the same reference numbers being used for corresponding details.

A special feature of this example is that on the output side the colour changer 17 is connected to a total of six coating agent nozzles 16.1-16.6 which therefore apply the same coating agent.

Another special feature of this exemplary illustration is that on the input side the colour changer 17 is only connected to five coating agent supply lines, of which four of the coating agent supply lines supply the primary colours of C, M, Y, K of the CMYK colour system while the fifth coating agent supply line supplies a special paint.

Figure 5:
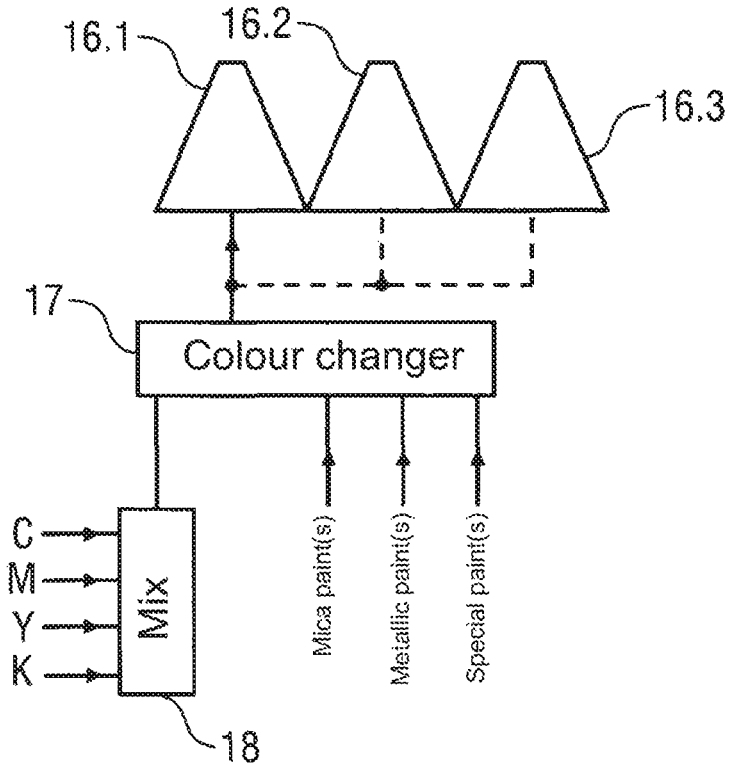
FIG. 5 shows a modification of FIG. 4A, where on the input side the colour changer is connected to a colour mixer which is supplied with the primary colours of a colour system.

The exemplary illustration of FIG. 5 partially corresponds with the exemplary illustration in FIG. 4A, so that to avoid repetition reference is made to the above description with the same reference numbers being used for corresponding details.

A special feature of this example is that on the input side the colour changer 17 is connected to a colour mixer 18, whereby on its input side the colour mixer 18 is connected to four coating agent supply lines which supply the four primary colours C, M, Y, K of the CMYK colour system. The colour mixer 18 can therefore mix any colour shade from the primary colours C, M, Y, K and supply it to the colour changer 17.

Furthermore, it can be seen from the drawing that the colour changer 17 can optionally only supply the coating agent nozzle 16.1 with the coating agent to be applied or also coating agent nozzles 16.2, 16.3 and, as required, other coating agent nozzles, which are not shown in the drawing.

Figure 6:
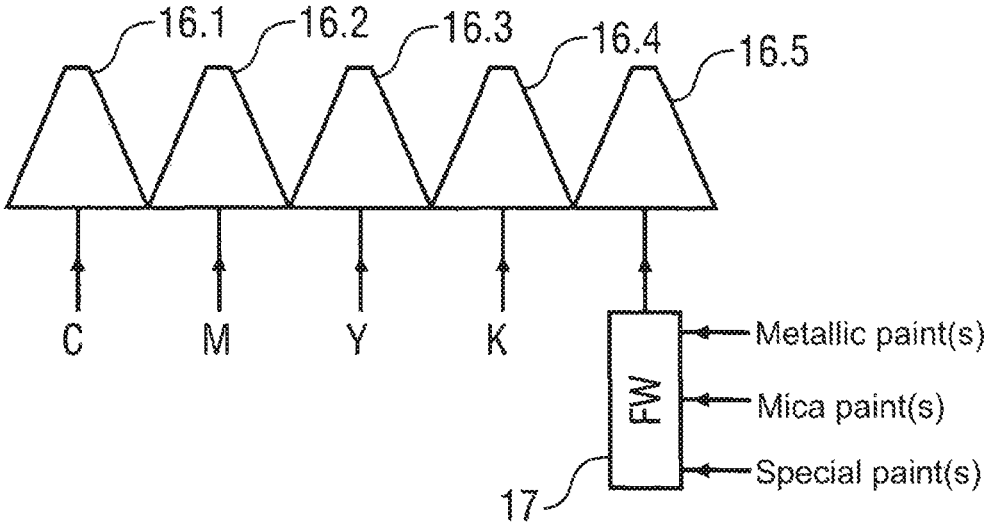
FIG. 6 shows a nozzle row of an exemplary print head with several coating agent nozzles where four of the coating agent nozzles are each supplied with one primary colour of a CMYK colour system, while the fifth coating agent nozzle is supplied with an effect paint.

The exemplary illustration of FIG. 6 again partially corresponds with the above-described exemplary illustrations, so that to avoid repetition reference is made to the above description with the same reference numbers being used for corresponding details.

A special feature of this illustration is that the adjacent coating agent nozzles 16.1-16.4 are each directly connected to a coating agent supply line via each of which one of the primary colours C, M, Y, K of the CMYK colour system is supplied.

On the other hand, the adjacent coating agent nozzle 16.5 is connected via the colour changer 17 to three further coating agent supply lines which supply a metallic paint, a mica paint and a special paint.

During operation the colour changer then may select a desired effect paint (metallic paint, mica paint or special paint) and apply the desired effect paint via the coating agent nozzle 16.5. In addition the four primary colours C, M, Y and K of the CMYK colour system are applied in the desired ratio via the coating agent nozzles 16.1-16.4. The primary colours C, M, Y, K then mix with the selected effect paint on the component to be coated.

Figure 7:
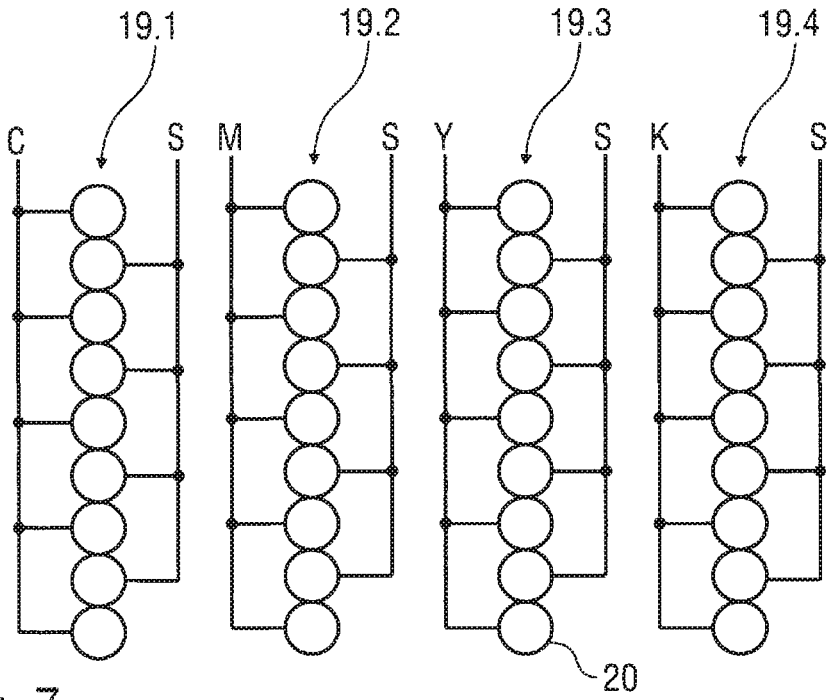
FIG. 7 shows several nozzle rows of an exemplary print head, to each of which one primary colour of a CMYK colour system is allocated.

FIG. 7 shows several nozzle rows 19.1-19.4 with numerous coating agent nozzles 20, whereby one of the four primary colours C, M, Y, K of the CMYK colour system is assigned to the individual nozzle rows 19.1-19.4. In this way the coating agent nozzles 20 of coating agent row 19.1 apply the primary colour C (cyan), while coating agent row 19.2 applies the primary colour M (magenta). The coating agent nozzles 20 of nozzle row 19.3 on the other hand apply the coating agent of the primary colour Y (Yellow), while the coating agent nozzles 20 of nozzle row 19.4 apply the coating agent of the primary colour K (Key=black).

In addition, the nozzle rows 19.1-19.4 can also apply a special paint S. In the individual nozzle rows 19.1-19.4 every second coating agent nozzle 20 is therefore connected to a special paint supply line. In the individual nozzle rows 19.1-19.4 the individual coating agent nozzles 20 can therefore alternately apply the special paint S and one of the four primary colours C, M, Y, K.

Figure 8:
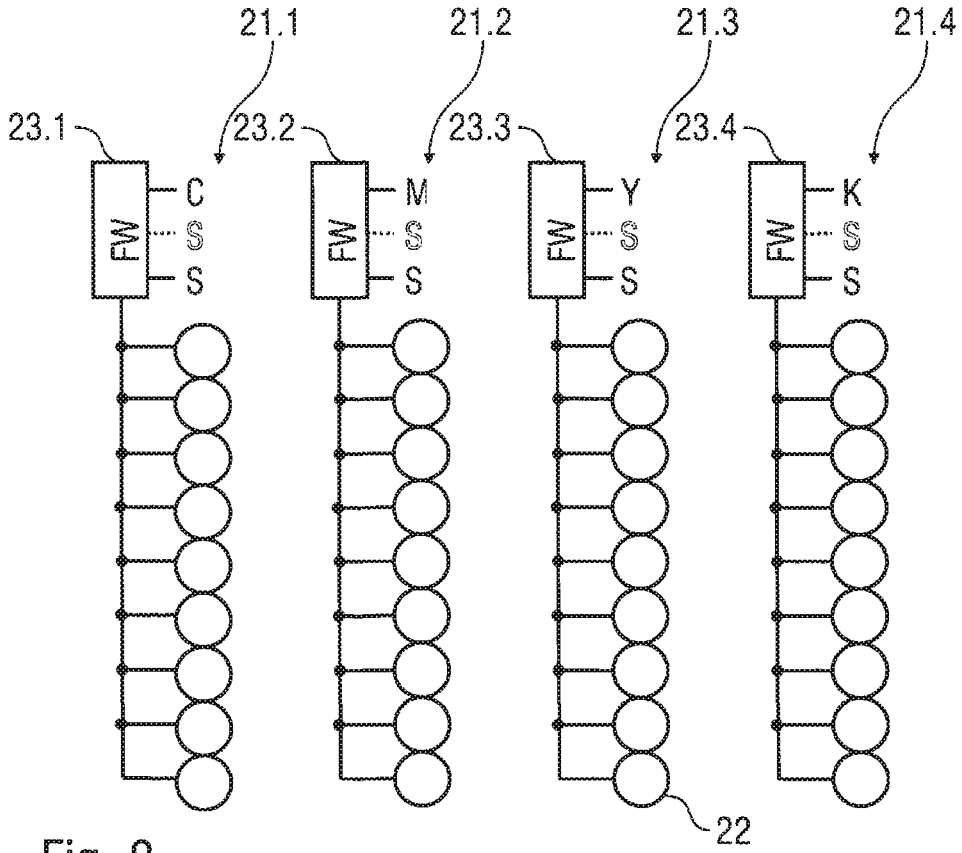
FIG. 8 shows several nozzle rows of an exemplary print head, to each of which a colour changer and one of the primary colours of a CMYK colour system is allocated.

FIG. 8 also shows four nozzle rows 21.1-21.4, which each comprise numerous coating agent nozzles 22.

In addition, four colour changers 23.1-23.4 are provided which each provide all the coating agent nozzles 22 of one of the four nozzle rows 21.1-21.4 with a coating agent. Thus, colour changer 23.1 supplies all the coating agent nozzles 22 of nozzle row 21.1, while colour changer 23.2 supplies all the coating agent nozzles 22 of nozzle row 21.2. By contrast the colour changer 23.3 supplies all the coating agent nozzles 22 of nozzle row 21.3, while colour changer 23.4 supplies all the coating agent nozzles 20 of nozzle row 21.4 with the coating agent to be applied.

On the input side the colour changers 23.1-23.4 are each supplied with a primary colour C, M, Y, K so that each of the primary colours C, M, Y, K is assigned to one of the four nozzle rows 21.1-21.4. The colour changers 23.1-23.4 are also connected to several special colour supply lines via which the special colours, metallic paints or suchlike can be supplied.

With this nozzle arrangement, too, colour mixing may take place on the component to be coated.

Figure 9:
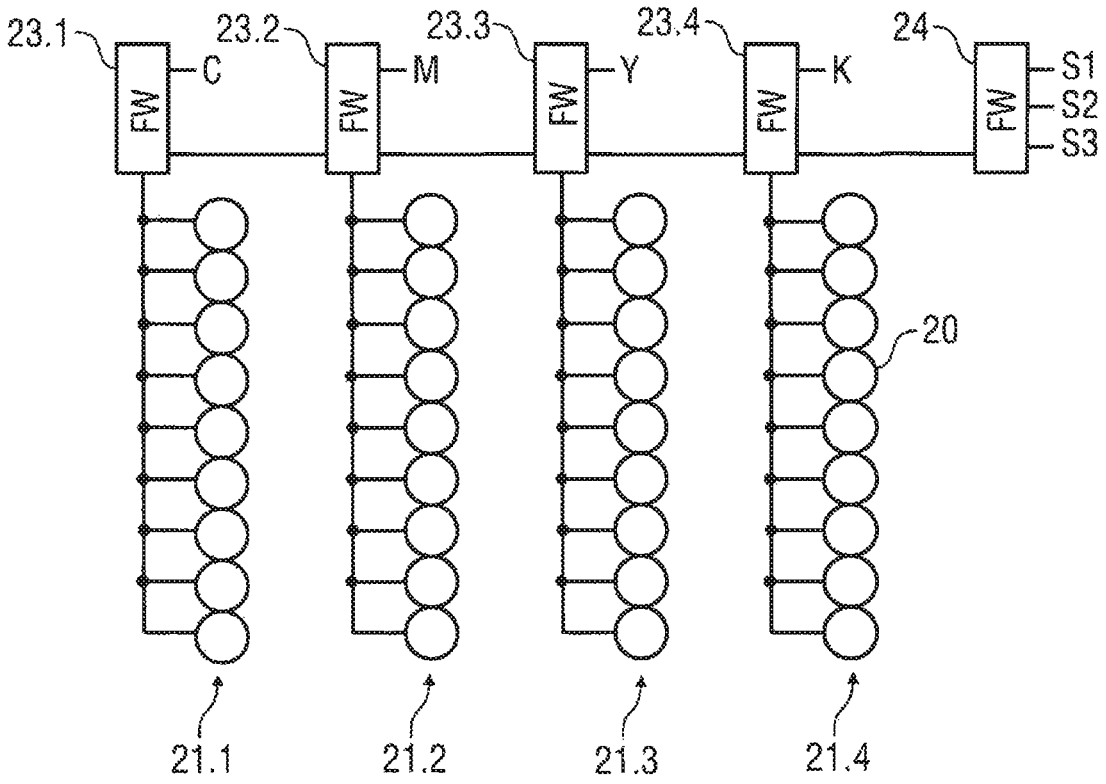
FIG. 9 shows several nozzle rows of an exemplary print head, to each of which a primary colour of a CMYK colour system and a colour changer is allocated, whereby the nozzle rows can alternatively be supplied with an effect paint via another colour changer.

The exemplary illustration of FIG. 9 corresponds partially with the exemplary illustration described above and shown in FIG. 8 so that to avoid repetition reference is made to the above description with the same reference numbers being used for corresponding details.

A special feature of this example is that on the input side the colour changers 23.1-23.4 are connected to a further colour changer 24, whereby on its input side colour changer 24 is supplied with three different effect paints S1, S2, S3. In operation the colour changer 24 thus selects one of the effect paints S1, S2 or S3 and makes the selected effect paint available for the other colour changers 23.1-23.4 to select. The colour changers 23.1-23.4 can therefore optionally select the relevant primary colour C, M, Y or K or the effect paint made available by the colour changer 24.

Figure 10:
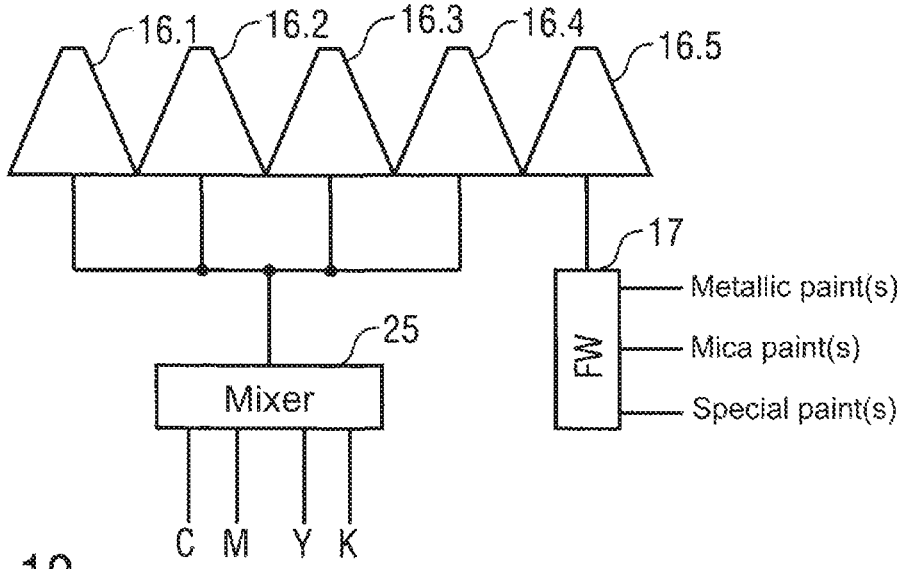
FIG. 10 shows a nozzle row of an exemplary print head whereby four adjacent coating agent nozzles are supplied with a mixed colour shade via a colour mixer, while the fifth coating agent nozzle is supplied with an effect paint via a colour changer.

The exemplary illustration of FIG. 10 partially corresponds with the exemplary illustration described above and shown in FIG. 6, so that to avoid repetition reference is made to the above description with the same reference numbers being used for corresponding details.

A special feature of this example is that the coating agent nozzles 16.1-16.4 are not supplied separately with one of the primary colours C, M, Y or K each. Rather, the coating agent nozzles 16.1-16.4 are jointly supplied with the coating agent to be applied by a colour mixer 25, whereby on its input side the colour mixer 25 is supplied with the primary colours C, M, Y, K of the CMYK colour system and is controlled to mix a desired colour shade which is then applied by coating agent nozzles 16.1-16.4.

Figure 11:
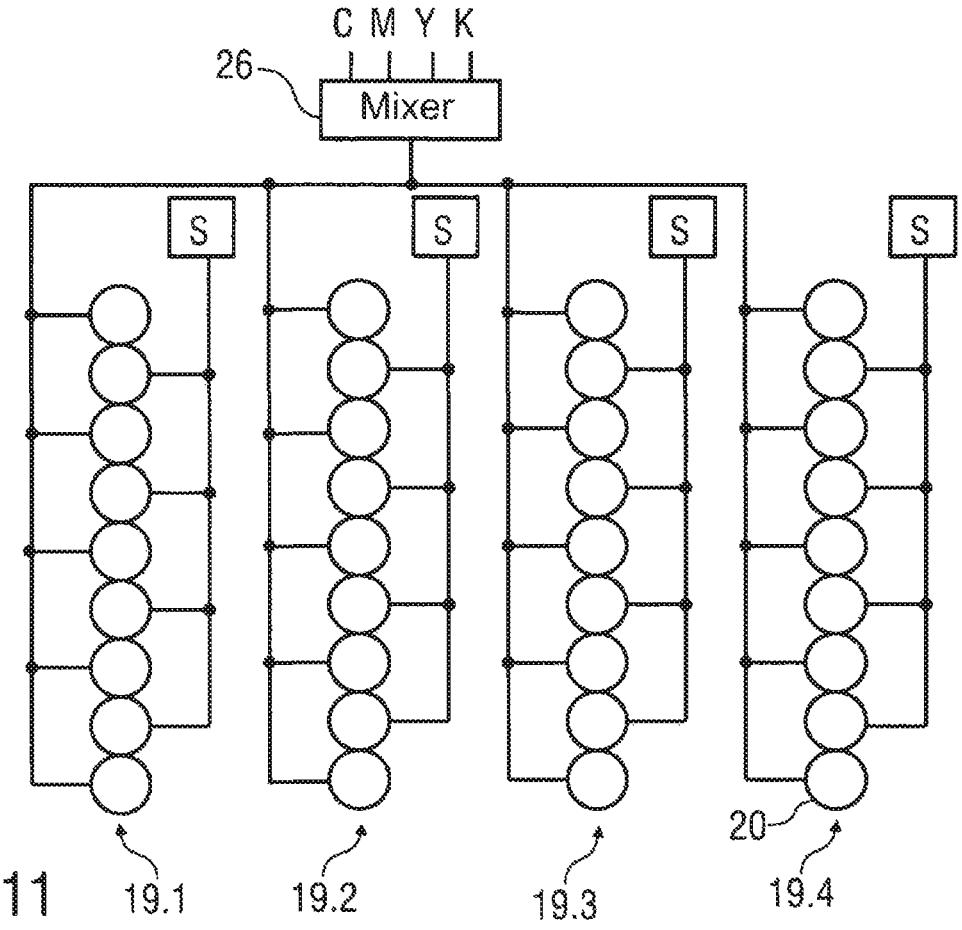
FIG. 11 shows several nozzle rows of an exemplary print head, which are jointly supplied with a mixed colour shade via a colour mixer.

The exemplary illustration of FIG. 11 corresponds partially with the exemplary illustration described above and shown in FIG. 7 so that to avoid repetition reference is made to the above description with the same reference numbers being used for corresponding details.

A special feature of this illustration is that the individual nozzle rows 19.1-19.4 are not supplied with the various primary colours but with a mixed together coating agent, which is mixed by a colour mixer 26 from the primary colours C, M, Y and K.

Figure 12:
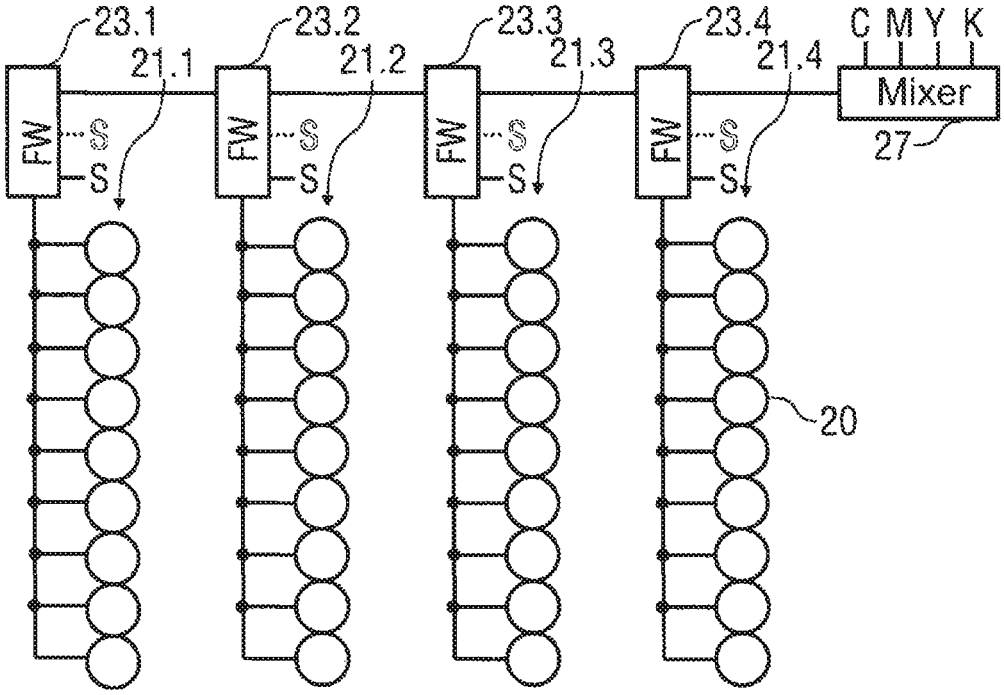
FIG. 12 show several nozzle rows of an exemplary print head each with one colour changer, whereby the colour changers of the individual rows are supplied with a mixed colour shade via a colour mixer.

The exemplary illustration of FIG. 12 corresponds partially with the exemplary illustration described above and shown in FIG. 8 so that to avoid repetition reference is made to the above description with the same reference numbers being used for corresponding details.

A special feature of this example is that the individual colour changers 23.1-23.4 are jointly supplied with a colour mixture which is supplied by a colour mixer 27, whereby on the input side the colour mixer 27 is supplied with the primary colours C, M, Y and K.

Figure 13:
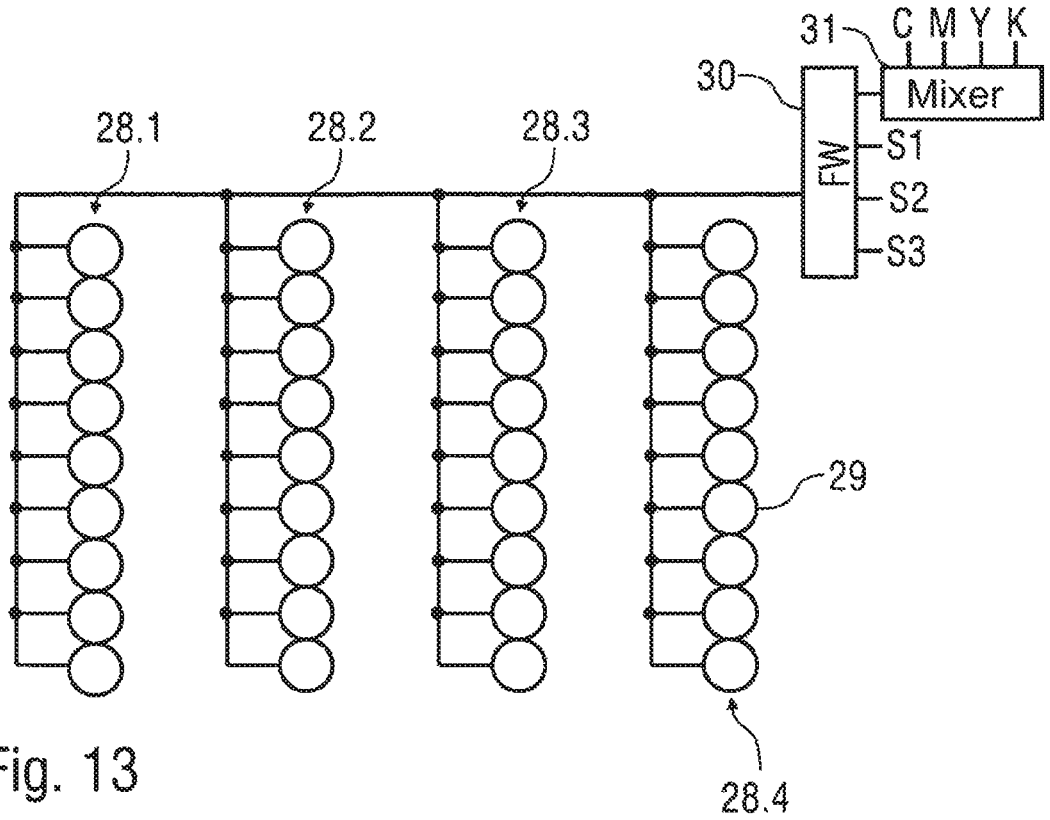
FIG. 13 shows several nozzle rows of an exemplary print head which are jointly supplied with the coating agent to be applied via a colour changer and a colour mixer.

FIG. 13 shows a further exemplary illustration of a nozzle arrangement in the print heads 8, 9, whereby four nozzle rows 28.1-28.4 are shown here which each have numerous coating agent nozzles 29. Here, all the coating agent nozzles 29 and all the coating agent rows 28.1-28.4 are jointly supplied with the coating agent from a colour changer 30.

On the input side the colour changer 30 is connected to three special colour supply lines via which the three special paints S1, S2, S3 are supplied.

In addition, on the input side the colour changer 30 is connected to a colour mixer 31 which from the primary colours, C, M, Y, K mixes a desired colour shade and makes it available to the colour changer 30 for selection.

Figure 14:
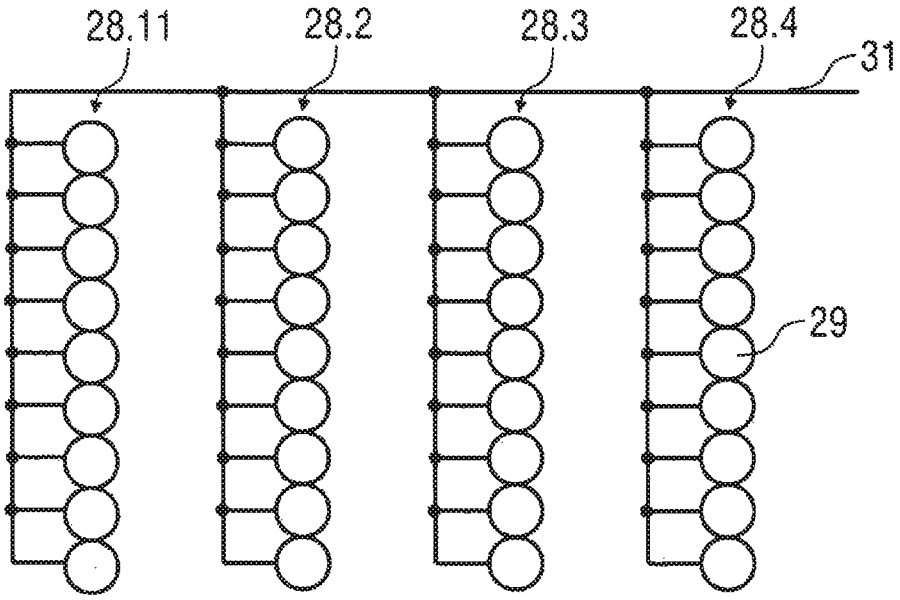
FIG. 14 shows several nozzle rows of an exemplary print head which are jointly supplied via a single coating agent supply line.

The exemplary illustration of FIG. 14 corresponds partially with the exemplary illustration which is described above and shown in FIG. 13, so that to avoid repetition reference is made to the above description with the same reference numbers being used for corresponding details.

A special feature of this exemplary illustration is that all the coating agent nozzles 29 in all the nozzle rows 28.1-28.4 are connected to a joint coating agent supply line 31 via which the same coating agent is supplied.

Figure 15:
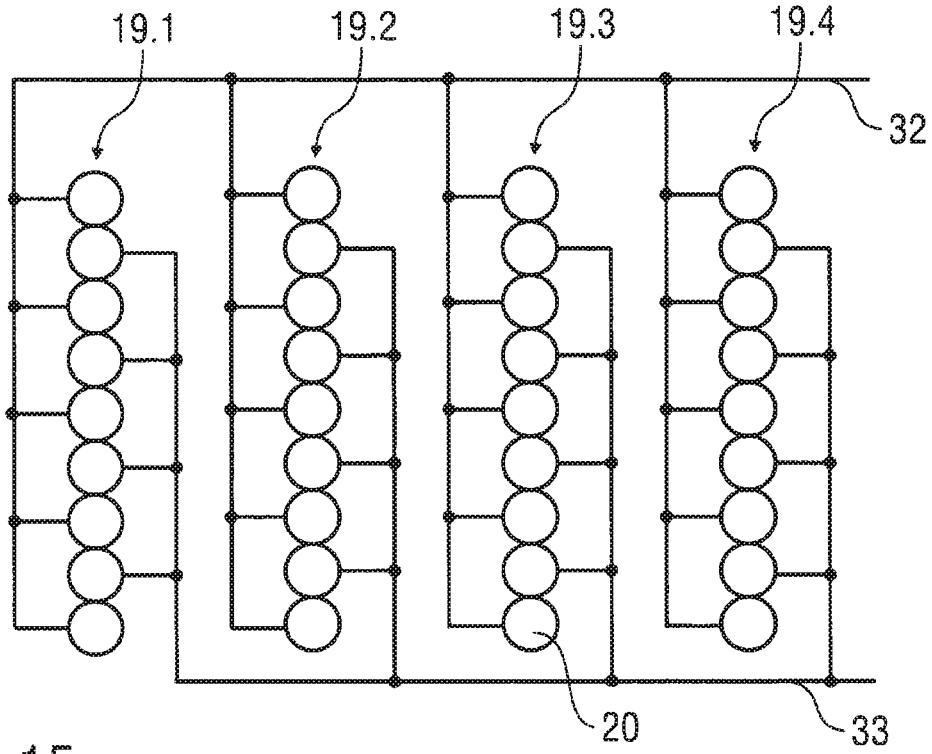
FIG. 15 shows several nozzle rows of an exemplary print head, whereby the individual nozzles within the nozzle row are alternately connected to a first coating agent supply line and a second coating agent supply line.

The exemplary illustration of FIG. 15 corresponds partially with the example of FIG. 11, so that to avoid repetition reference is made to the above description.

A special feature of this exemplary illustration is that the coating agent nozzles 20 in the individual nozzle rows 19.1-19.4 are alternately connected to a first coating agent supply line 32 and a second coating agent supply line 33.

Figure 16:
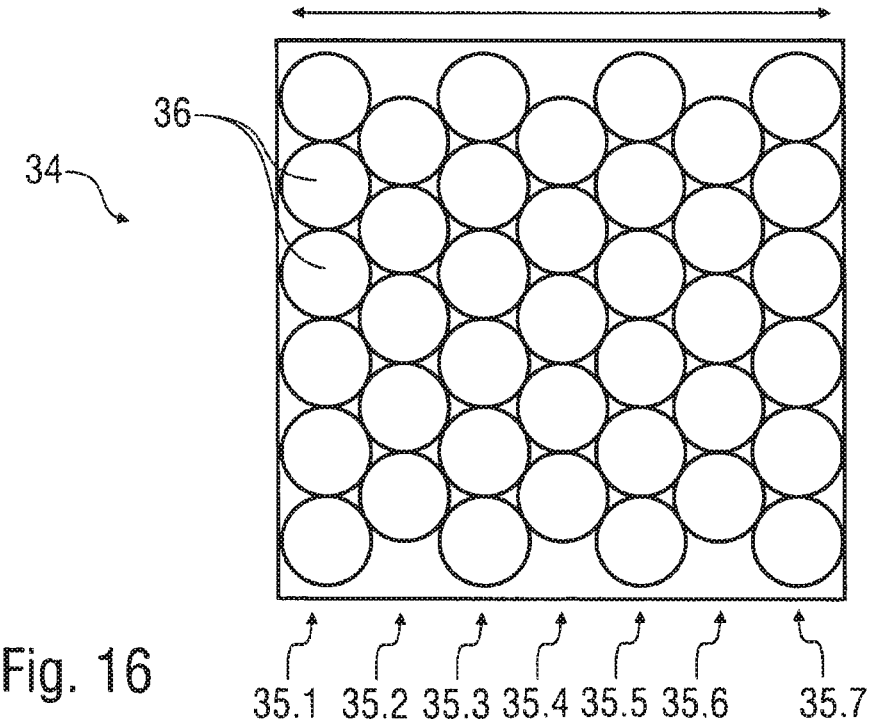
FIG. 16 shows an exemplary nozzle arrangement in a print head.

FIG. 16 shows a nozzle arrangement 34 for the print heads 8, 9 of the painting installation according to one exemplary illustration, whereby the arrow indicates the direction of advance of the print heads 8, 9, i.e. the direction of the pressure.

From the drawing it can be seen that the nozzle arrangement 34 has several nozzle rows 35.1-35.7 each of which comprise several coating agent nozzles 36.

Within the entire nozzle arrangement 34 the coating agent nozzles 36 have a nozzle opening of uniform size.

The adjacent nozzle rows 35.1-35.7 are offset with regard to each other in the longitudinal direction by half the width of a nozzle, which allows a maximum packing density of the coating agent nozzles 36 within the nozzle arrangement 34.

Figure 17:
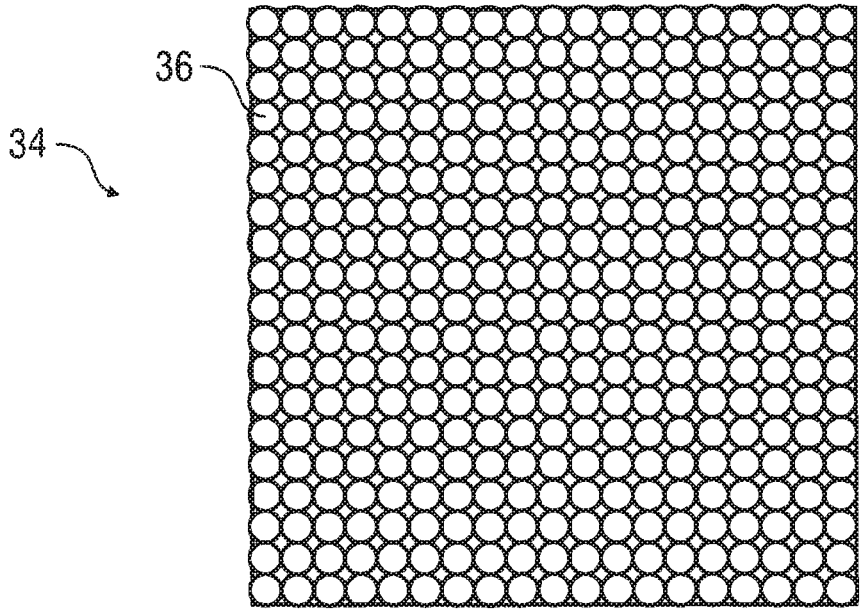
FIG. 17 shows an alternative exemplary nozzle arrangement in the print head with smaller coating agent nozzles.

FIG. 17 shows a modification of a nozzle arrangement 34 which largely corresponds with the nozzle arrangement described above and shown in FIG. 16, so that to avoid repetition reference is made to the above description.

A special feature of this exemplary illustration is that the individual nozzles 36 have a much smaller nozzle size.

A further special feature of this exemplary illustration is that the adjacent nozzle rows are not offset with regard to each other.

Figure 18:
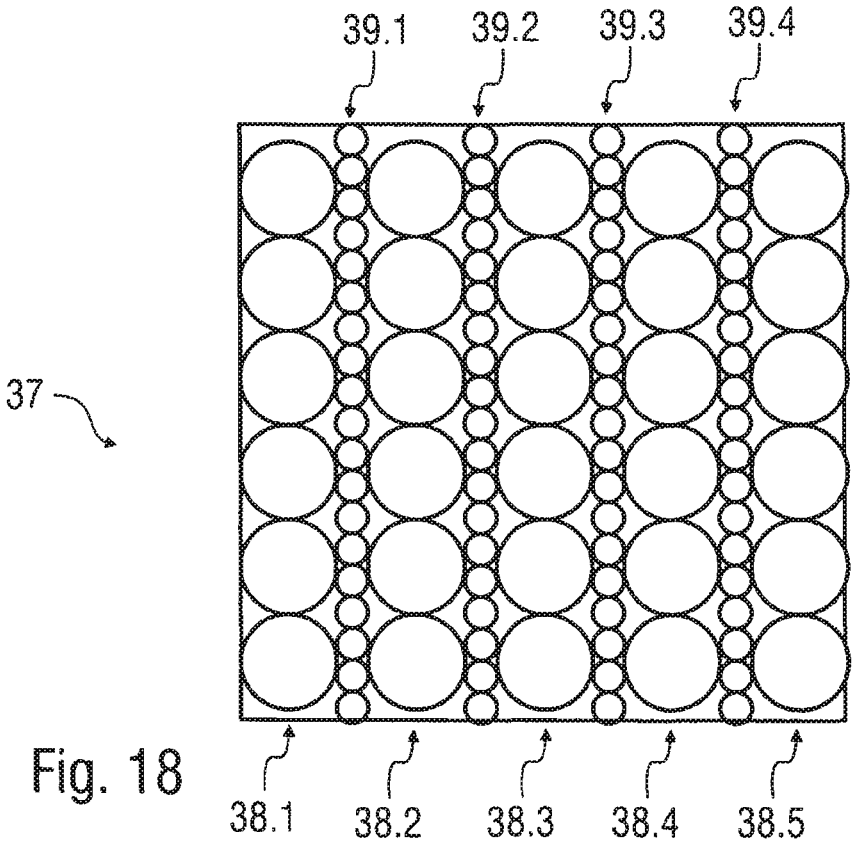
FIG. 18 shows an exemplary alternative arrangement of the coating agent nozzles in the print head, whereby the coating agent nozzles have different nozzle sizes.

FIG. 18 shows a further exemplary illustration of a nozzle arrangement 37 with five parallel nozzle rows 38.1-38.5 with relative large nozzle openings and four nozzle rows 39.1-39.4 with relatively small nozzle openings.

Figure 19:
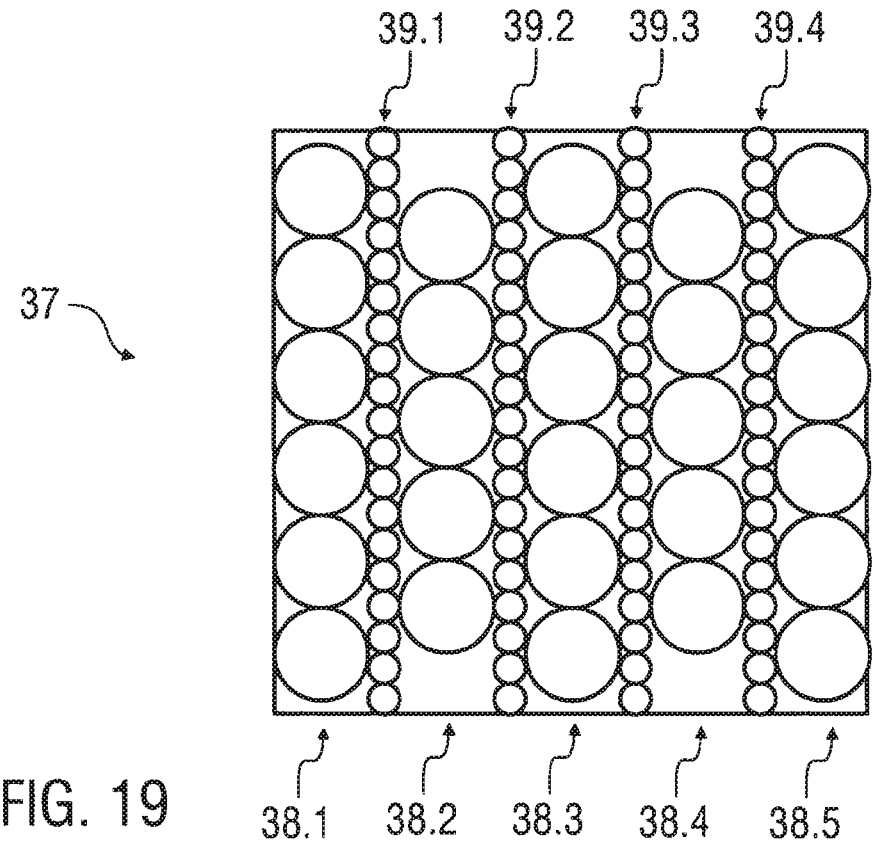
FIG. 19 shows a modification of FIG. 18, wherein the nozzle rows with the larger coating agent nozzles are arranged offset with regard to each other.

The exemplary illustration in accordance with FIG. 19 largely corresponds with the example shown in FIG. 18 and described above, so that to avoid repetition reference is made to the above description with the same reference numbers being used for corresponding details.

A special feature of this exemplary illustration is that the nozzle rows 38.1-38.5 with the larger nozzle openings are offset with regard to each other in the longitudinal direction by half the width of a nozzle.

Figure 20:
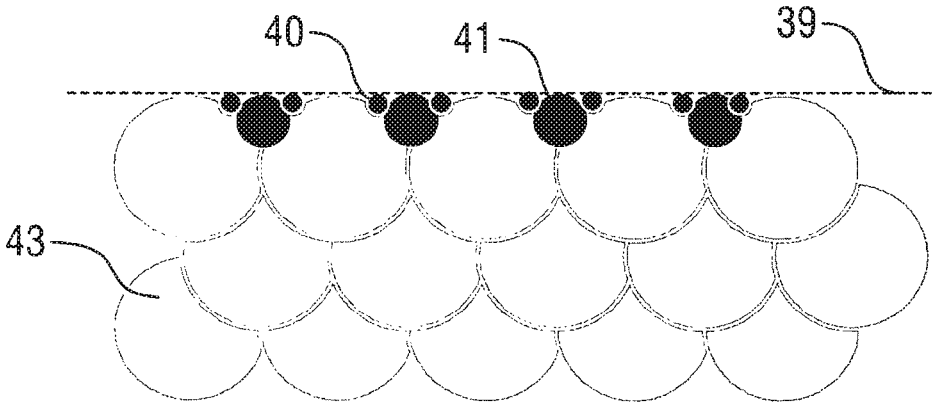
FIG. 20 shows a diagram for clarifying the painting of a sharp edge with the print head, according to one exemplary illustration.

FIG. 20 shows a diagram for painting a sharp edge 39. It can be seen that the edge 39 is composed of variously large coating agent surfaces 40, 41, 42 whereby the differently sized coating agent surfaces 40-42 are produced by differently sized coating agent nozzles.

When printing graphics, larger areas of a colour shade are printed with the large coating agent nozzles whereas areas requiring a certain edge sharpness are refined with smaller coating agent nozzles. This method is particularly useful in two-tone painting (e.g. in the sill area of a vehicle body in contrasting colours). In the figure an edge area is shown in which the edge area is sharply printed with three nozzle sizes.

Figure 21:
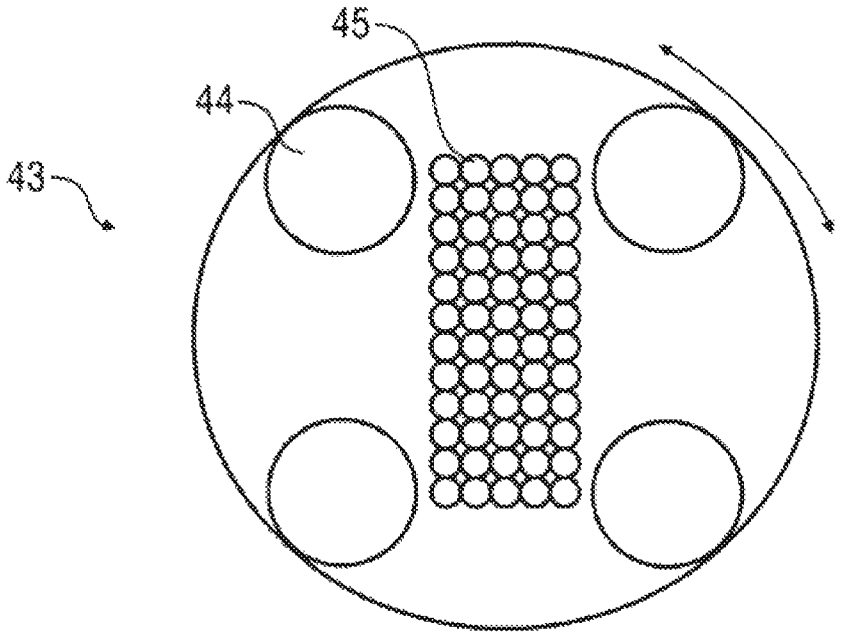
FIG. 21 shows a rotating print head.

FIG. 21 schematically shows a rotatable print head 43 with four large coating agent nozzles 44 and numerous smaller coating agent nozzles 45, whereby the larger coating agent nozzles 44 are arranged on the outside with regard to the axis of rotation of the print head 43 while the smaller coating agent nozzles 45 are located on the inside with regard to the axis of rotation of the print head 43.

Figure 22:
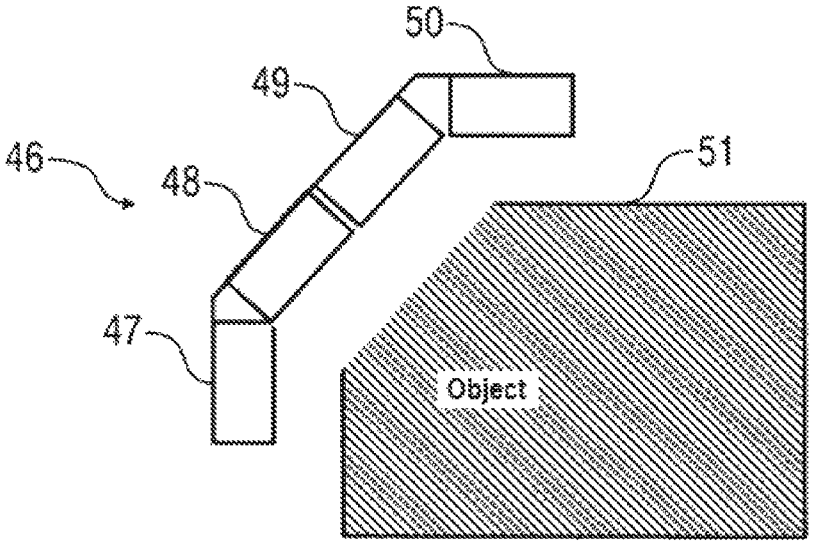
FIG. 22 shows a print head arrangement with several swivelling print heads for adaptation to curved component surfaces.

Finally, FIG. 22 shows a print head arrangement 46 with a total of four print heads 47-50 which can be swivelled with regard to each other in order to allow better adaptation to the surface of a curved component 51.

Figure 23:
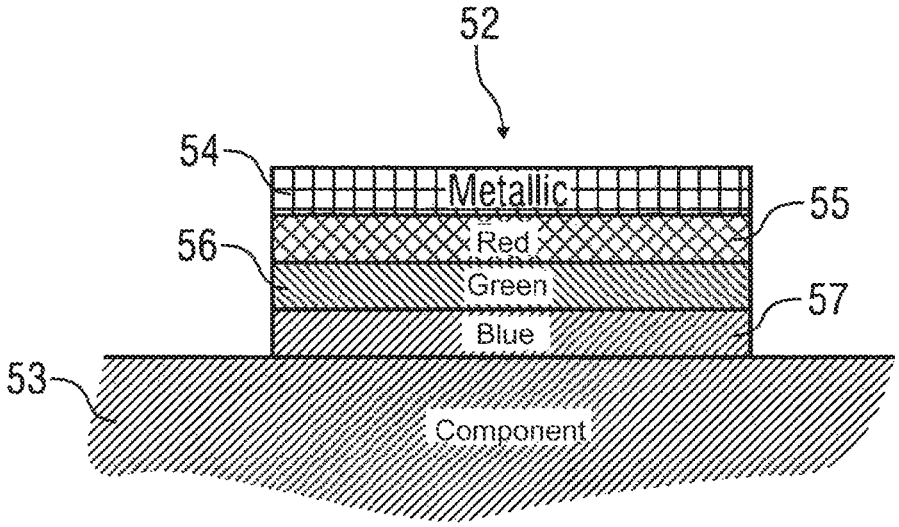
FIG. 23 shows a layered pixel with several layers in the primary colours of a colour system and an uppermost layer of a metallic paint.

FIG. 23 shows a pixel 52, which can be applied to a component 53 with the exemplary coating methods by means of a print head, whereby for the sake of simplicity a single pixel 52 is shown in the drawing. However, in practice numerous pixels 52 are applied.

The pixel 52 comprises several layers 54-57 arranged on top of each other.

The three lower layers 55-57 are of the primary colours red, green and blue of the RGB colour system. Alternatively, however, the lower layers can be in the primary colours of a different colour system, such as the CMYK colour system. Through subtractive colour mixing the layers 55-57 lying on top of each other then produce a certain colour shade.

Figure 24:
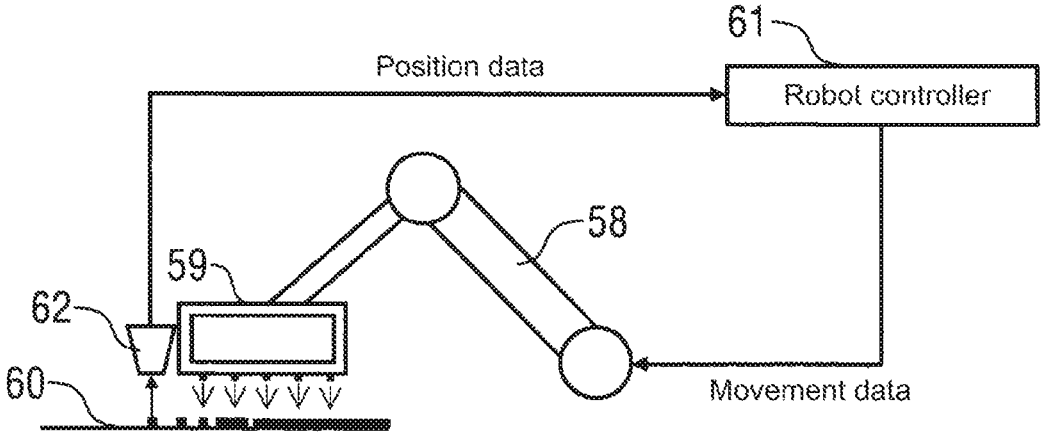
FIG. 24 shows a schematic view of an exemplary coating device with a multiple axis robot which controls a print head and sensor in order to position the print head.

The uppermost layer on the other hand consists of a semi-transparent metallic paint in order to achieve a metallic effect. In a very simplified form FIG. 24 shows a coating device according to one exemplary illustration with a multiple axis robot 58 which moves a print head 59 along predefined coating agent paths over a component surface 60, whereby the robot is 58 is operated by a robot controller 61. The robot controller 61 controls the robot 58 in such a way that the print head 59 is guided along predefined coating agent paths over the component surface 60 whereby the coating agent paths lie adjacent to each other in a meandering pattern.

A special feature is that an optical sensor 62 is also attached to the print head 59 which during operation detects the position and course of the previous coating agent paths so that the current coating agent path can be exactly aligned with regard to the previous coating agent path.

Figure 25:
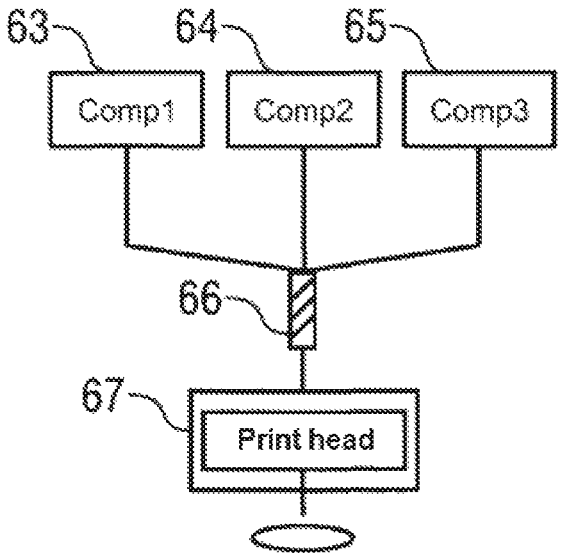
FIG. 25 shows a schematic view of an exemplary coating device in which several components are mixed to form a mixture, whereby the print head then applies the mixture.

FIG. 25 shows in a very simplified form a variant of an exemplary coating device with three separate coating agent supply lines 63-65, which each supply one component of the coating agent to be applied.

On the output side the coating agent supply lines 63-65 are connected to a mixer 66 which mixes the individual components into a coating agent mixture which is then supplied to a print head 67. Mixing of the various components of the coating agent thus takes place before application by the print head 67.

Figure 26:
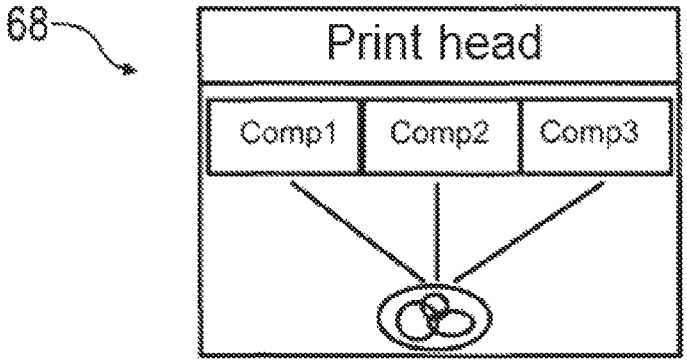
FIG. 26 shows a schematic view of a print head which applies several components independently of each other, whereby mixing takes place on the component surface, according to one exemplary illustration.

In contrast FIG. 26 shows in simplified form a print head 68 which applies three different components of a coating agent separately onto the vehicle component surface, whereby mixing of the individual components only takes place on the vehicle component surface.

Figure 27:
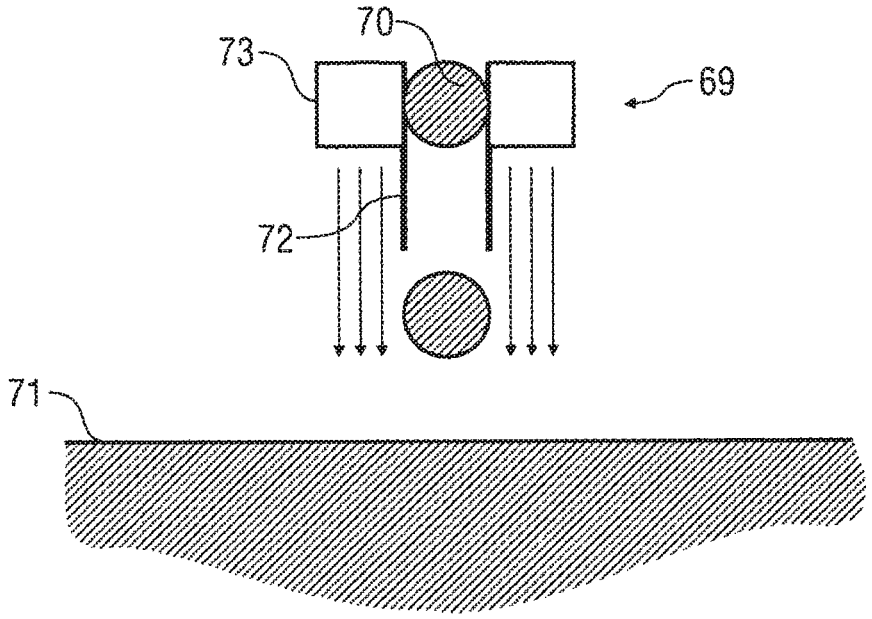
FIG. 27 shows a schematic view of an exemplary print head with a sheath flow nozzle.

FIG. 27 schematically shows a print head 69 for applying coating agent droplets 70 onto a vehicle component surface 71.

Here the print head 69 has a coating agent nozzle 72 from which the individual coating agent droplets 70 are discharged pneumatically or in another manner.

In addition, the print head 69 has a sheath flow nozzle 73 which annularly surrounds the coating agent nozzle 72 and emits a circular sheath flow which surrounds the individual coating agent droplets 70.

On the one hand this atomises/delimits the individual coating agent droplets 70.

On the other hand the sheath flow emitted from the sheath flow nozzle 73 directs any overspray in the direction of the component surface 71 and thereby improves the application efficiency.

Figure 28:
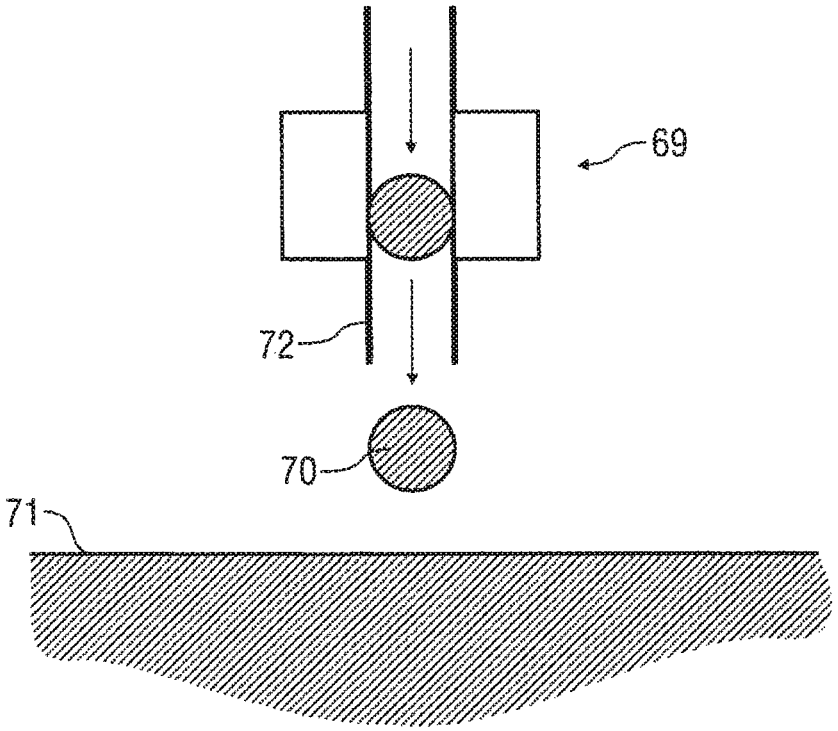
FIG. 28 shows a schematic view of an exemplary print head in which the coating agent droplets are pneumatically discharged and accelerated.

FIG. 28 shows, also in a very simplified form, an exemplary print head 69 which partially corresponds with the print head 69 according to FIG. 27 so that to avoid repetition, reference is made to the above description with the same reference numbers being used for corresponding details.

A special feature of this exemplary illustration is that the individual coating agent droplets 70 are pneumatically discharged from the coating agent nozzle 72 whereby the coating agent droplets 70 are pneumatically accelerated as a result of which the maximum possible painting distance is increased, as the individual coating agent droplets 70 have a greater kinetic energy due to the pneumatic acceleration.

Figure 29:
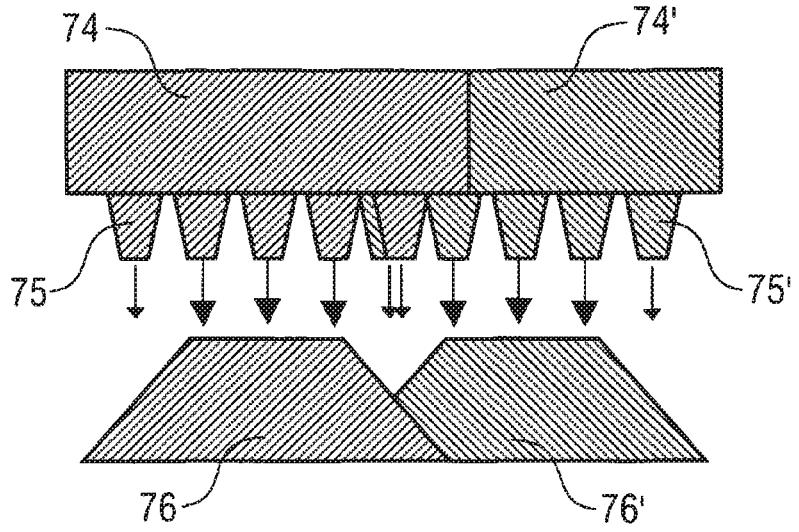
FIG. 29 shows a schematic view of a print head which generates a trapezoidal layer thickness distribution.

In a very simplified form FIG. 29 shows a print head 74 during the application of two adjacent paint paths, whereby the position of the print head 74 in the current paint path is shown without an apostrophe, while the position of the print head 74' in the previous painting path is shown with an apostrophe.

The print head 74 has coating agent nozzles 75 arranged transversely to the path direction, whereby the outer coating agent nozzles 75 emit less coating agent than the inner coating agent nozzles 75. As a result the print head 74 achieves a trapezoidal layer thickness distribution 76 on the component surface. This is advantageous as the trapezoidal layer thickness distribution 76 is then superimposed on the also trapezoidal layer thickness distribution 76' of the previous paint path which leads to a constant layer thickness.

Figure 30:
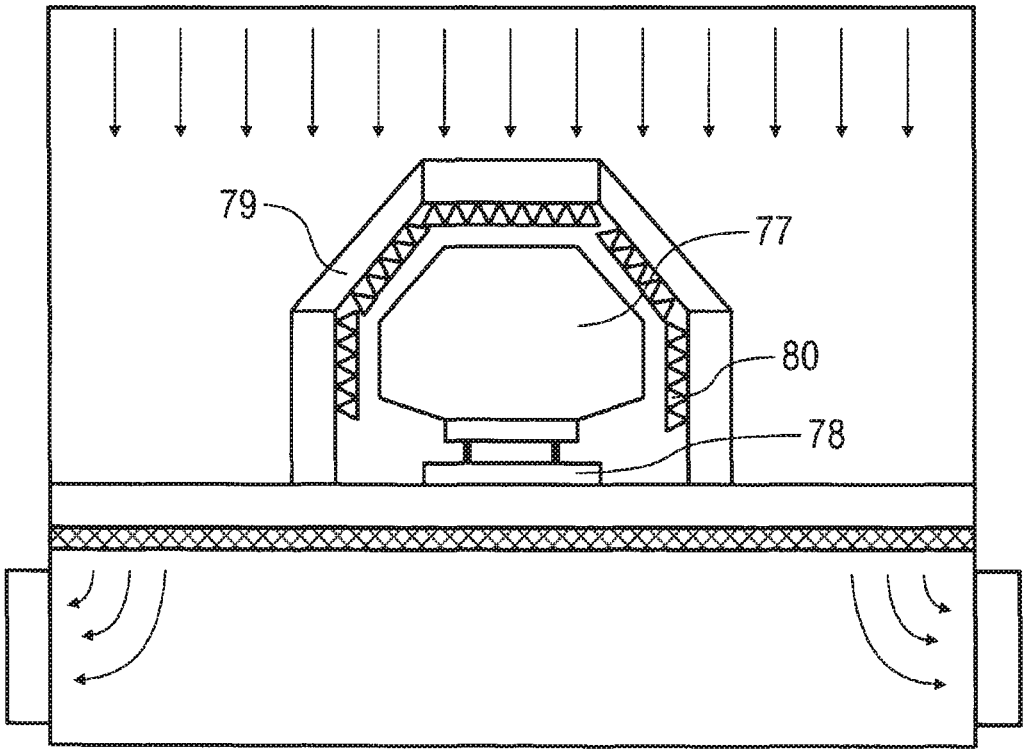
FIG. 30 shows a schematic view of an exemplary coating device in which numerous print heads are mounted on a portal.

In a simplified form FIG. 30 shows a coating device according to one exemplary illustration in which the components 77 to be coated are transported along linear conveyor path 78 through a painting cabin, which is in itself known from the prior art and does not therefore need to be described in more detail.

A portal 79 spans the conveyor path 78 whereby attached to the portal are numerous print heads 80 which are directed at the components 77 on the conveyor path 78 and coat these with a coating agent.

Figure 31:
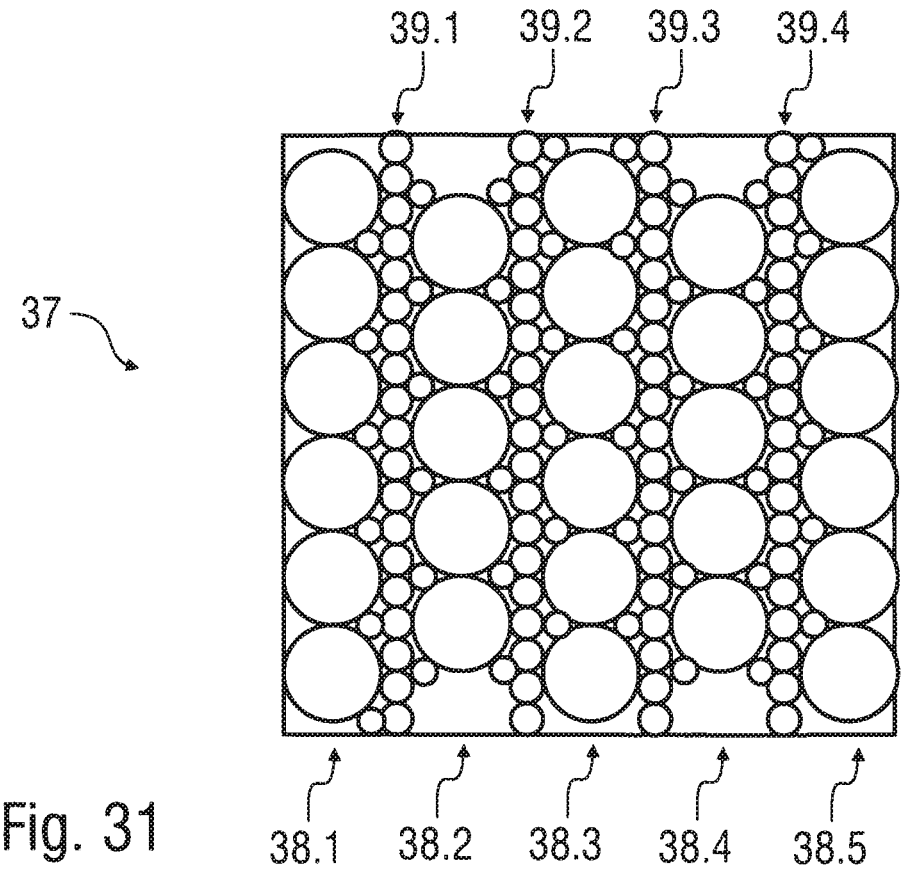
FIGS. 31 and 32 show modifications of FIGS. 18 and 19 with a maximum packing density of the individual nozzles.

FIG. 31 shows a modification of FIG. 19, so that to avoid repetition reference is made to the above description with the same reference numbers being used for corresponding details.

A special feature of this exemplary illustration is the much greater packing density of the individual coating agent nozzles.

Figure 32:
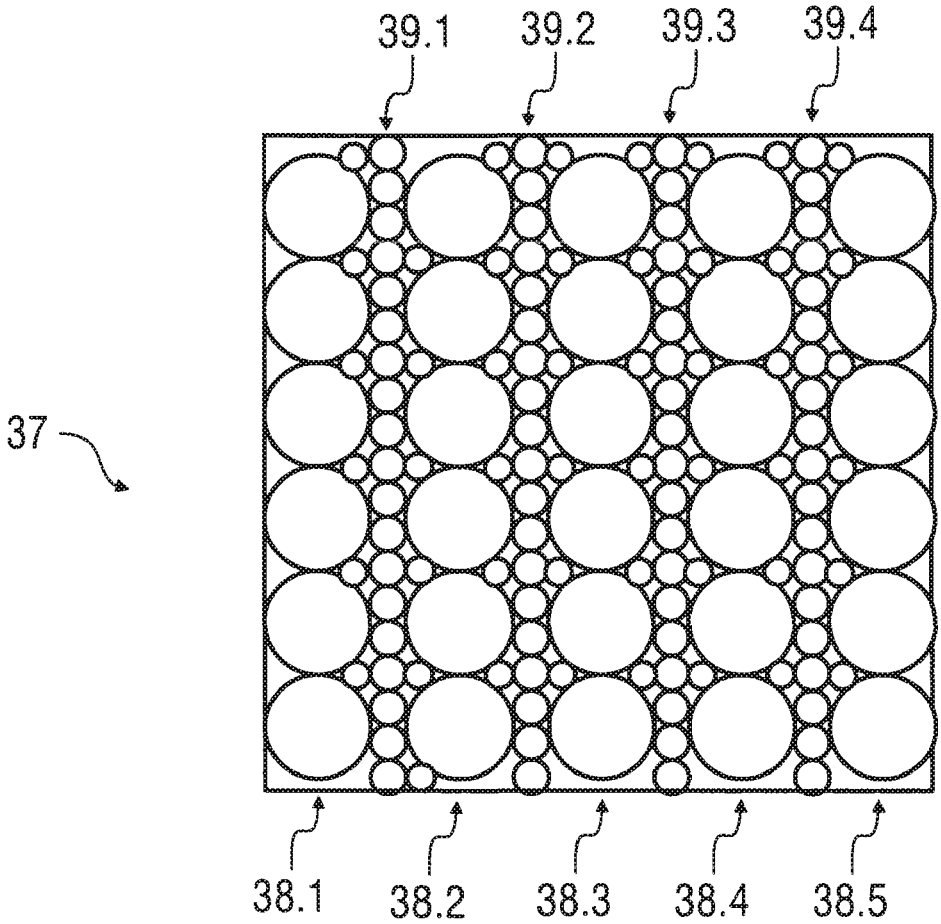

FIG. 32 shows a modification of FIG. 18, so that to avoid repetition reference is made to the above description with the same reference numbers being used for corresponding details.

Here too, the special feature is that the packing density of the individual coating agent nozzles is much greater.

The exemplary illustrations are not restricted to the above-described examples. Rather, a large number of variants and modifications are possible, which also make use of the inventive ideas and therefore come under the scope of protection.

Reference in the specification to "one example," "an example," "one embodiment," or "an embodiment" means that a particular feature, structure, or characteristic described in connection with the example is included in at least one example. The phrase "in one example" in various places in the specification does not necessarily refer to the same example each time it appears.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claimed invention.

Accordingly, it is to be understood that the above description is intended to be illustrative and not restrictive. Many embodiments and applications other than the examples provided would be evident upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In sum, it should be understood that the invention is capable of modification and variation and is limited only by the following claims.

All terms used in the claims are intended to be given their broadest reasonable constructions and their ordinary meanings as understood by those skilled in the art unless an explicit indication to the contrary is made herein. In particular, use of the singular articles such as "a," "the," "the," etc. should be read to recite one or more of the indicated elements unless a claim recites an explicit limitation to the contrary.

LIST OF REFERENCES

1 Conveyor
2 Painting cabin
3 Painting robot
4 Painting robot
5 Plenum
6 Ceiling
7 Wash-out
8 Print head
9 Print head
10 Air extractor
11 Filter ceiling
12 Coating agent nozzle
13 Colour changer
14.1-14.4 Coating agent nozzles
15.1-15.4 Colour changer
16.1-16.6 Coating agent nozzles
17 Colour changer
18 Colour mixer
19.1-19.4 Nozzle rows
20 Coating agent nozzles
21.1-21.4 Nozzle rows
22 Nozzle rows
23.1-23.4 Colour changer
24 Colour changer
25 Colour mixer
26 Colour mixer
27 Colour mixer
28.1-28.4 Nozzle rows
29 Coating agent nozzle
30 Colour changer
31 Coating agent supply line
32 Coating agent supply line
33 Coating agent supply line
34 Nozzle arrangement
35.1-35.7 Nozzle rows
36 Coating agent nozzles
37 Nozzle arrangement
38.1-38.5 Nozzle rows
39 Edge
40-42 Coating agent surfaces
43 Print head
44 Coating agent nozzles
45 Coating agent nozzles
46 Print head arrangement
47-50 Print heads
51 Component
52 Pixel
53 Component
54-57 Layers
58 Robot
59 Print head
60 Component surface
61 Robot controller
62 Sensor
63 Coating agent supply
66 Mixer
67 Print head
68 Print head
69 Print head
70 Coating agent droplet
71 Component surface
72 Coating agent nozzle
73 Sheath flow nozzle
74, 74' Print head
75, 75' Coating agent nozzles
76, 76' Layer thickness distribution
77 Components
78 Conveyor
79 Portal
80 Print heads

The invention claimed is:

1. A coating device for coating a component having a component surface having a predetermined course and guide path for coating agent, comprising:

a multiple axis robot having a moveable end;

an application device attached to the moveable end of the multiple axis robot, the application device being adapted to apply coating agent, the application device including a print head having a plurality of coating agent nozzles, the plurality of coating agent nozzles being adapted to discharge coating agent, the plurality of coating agent nozzles being arranged in a plurality of rows, the application device further including a sensor attached to the print head, the sensor being adapted to detect a spatial position of the print head as a function of the predetermined course and guide path for coating agent; and a robot controller communicatively coupled to the sensor and the multiple axis robot, the robot controller adapted to receive position data from the sensor and to transmit movement data to the multiple axis robot, the position data including the spatial position of the print head as a function of the predetermined course and guide path of applied coating agent, wherein the robot controller is adapted to determine a current course and guide path for the print head corresponding to the predetermined course and guide path as a function of the position data, and the robot controller is adapted to command the multiple axis robot to position the print head on the current course and guide path for the print head.

2. The coating device of claim 1, wherein the sensor is an optical sensor.

3. The coating device of claim 1, wherein the robot controller is adapted to determine the current course and guide path for the print head in further correspondence to a previous course and guide path of a previously applied coating.

4. The coating device of claim 3, wherein the print head is adapted to apply one of a UV responsive colour and an IR responsive colour.

* * * * *